United States Patent [19]

Braddick

[11] Patent Number: 4,966,236

[45] Date of Patent: Oct. 30, 1990

[54] CEMENTING METHOD AND ARRANGEMENT

[75] Inventor: Britt O. Braddick, Houston, Tex.

[73] Assignee: Texas Iron Works, Inc., Houston, Tex.

[21] Appl. No.: 348,221

[22] Filed: May 9, 1989

Related U.S. Application Data

[63] Continuation of Ser. No. 147,701, filed as PCT US87/01924 on Aug. 12, 1987, abandoned.

[51] Int. Cl.[5] ..... E21B 33/16

[52] U.S. Cl. ..... 166/291; 166/153; 166/155; 166/156

[58] Field of Search ..... 166/153–156, 166/192, 208, 291, 196

[56] References Cited

U.S. PATENT DOCUMENTS

| | | | |
|---|---|---|---|
| 3,223,170 | 12/1965 | Mott | 166/208 |
| 3,364,996 | 1/1968 | Brown | 166/120 |
| 3,472,520 | 10/1969 | Burns | 166/196 X |
| 3,545,542 | 12/1970 | Scott | 166/155 |
| 3,635,288 | 1/1972 | Lebourg | 166/156 |
| 3,777,819 | 12/1973 | Delano | 166/285 |
| 3,796,260 | 3/1974 | Bradley | 166/153 |
| 3,920,075 | 11/1975 | Braddick et al. | 166/290 |
| 3,993,128 | 11/1976 | Braddick | 166/216 |
| 4,010,804 | 3/1977 | Garcia | 166/315 |
| 4,042,014 | 8/1977 | Scott | 166/154 |
| 4,047,566 | 9/1977 | Duke | 166/285 |
| 4,060,131 | 11/1977 | Kennedy et al. | 166/315 |
| 4,281,711 | 8/1981 | Braddick | 166/118 |
| 4,562,889 | 1/1986 | Braddick | 166/381 |
| 4,624,312 | 11/1986 | McMullin | 166/155 |
| 4,671,358 | 6/1987 | Lindsey, Jr. et al. | 166/291 |
| 4,688,642 | 8/1987 | Baker | 166/382 |

OTHER PUBLICATIONS

"RP Liner Setting Assembly Used for Rotate and Reciprocate Cementing", Texas Iron Works, Inc., 80–81 Catalog, p. 6850.

"RRP Liner Setting Assembly for Extended Rotation", Texas Iron Works, Inc., 1982–1983 Catalog, p. 7914.

C. R. Hyatt and M. H. Partin, Jr., "Liner Rotation and Proper Planning Improve Primary Cementing Success", Texas Iron Works, Inc., SPE 12607, Reprint, PSE Deep Drilling and Production Symposium, Amarillo, TX, Apr. 1–3, 1984.

Juan A. Garcia, "Rotating Liner Hanger Helps Solve Cementing Problems", reprinted by Petroleum Engineer International, Sep., 1985, expressly for Texas Iron Works, Inc.

API Bulletin D17, "Running and Cementing Liners in the Delaware Basin, Texas", First Addition, Dec. 1974.

(List continued on next page.)

*Primary Examiner*—Bruce M. Kisliuk

*Attorney, Agent, or Firm*—Jack W. Hayden

[57] ABSTRACT

An operating string O is provided for conducting cementing operations in a well bore.

The operating string O is shown sealably and releasably connected with a liner L and extends through upper liner wiper means 45 and terminates in overlapping relationship to lower liner wiper means 26, both of which wiper means 26 and 45 are releasably secured to the operating string O with the lower liner wiper means 26 releasably secured below the upper liner wiper means 45 so that its bore 28*a* originates adjacent and extends away from the lower end of the upper liner wiper means 45.

The operating string O includes positioning means H to hang the liner L on well bore casting C, and means 145, 146 and 148 to rotate and reciprocate the liner L before hanging it and/or to rotate the liner L during and after cementing. The hanger means H includes rows 90*a*, 91*a*′ of cone segments 16*a*, 17*a* and rows 18, 19 of slip segments 18*a*, 19*a* with sleeve S′ supporting the cone segments 16*a*, 17*a* with sleeve S″ supporting the slip segments 18*a*, 19*a*, with at least one sleeve movable longitudinally for simultaneously setting all the hangers on the casing C.

91 Claims, 10 Drawing Sheets

OTHER PUBLICATIONS

H. Ed Lindsey, "Liner Cementing Equipment and Techiques", Southwestern Petroleum Short Course Association, 1977.

H. E. Lindsey, Jr., "New Tools Make Liner Rotation During Cementing Practical", Reprinted from World Oil, Oct. 1981.

H. E. Lindsey, Jr., "Recent Developments in Tools for Liner Movement During Cementation", Southwestern Petroleum Short Course Association, 1981.

W. T. Lee and W. D. Dorge, "Cementing—Simultaneous Rotation—Reciprocating Techique (ROTO-TEK System)", IADC/SPE 11419, IADC/SPE 1983 Drilling Conference, New Orleans, LA, Feb. 20-23, 1983.

W. R. Landrum and R. D. Turner, "Rotating Liners During Cementing in the Grand Isle and West Delta Area", IADC/SPE 11420, IADC/SPE 1983 Drilling Conference, New Orleans, LA., Feb. 20-23, 1983.

R. Buchan and M. T. S. Little, "Innovative Techniques Improve Liner Cementation in North Seat Wells: An Operator's Experience", SPE 15896, SPE European Petroleum Conference, London, Oct. 20-22, 1986.

M. A. Arceneaux and R. L. Smith, "Liner Rotation While Cementing: An Operator's Experience in South Texas", SPE/IADC 1985 Drilling Conference, New Orleans, LA., Mar. 6-8, 1985.

H. E. Lindsey, "Rotate Liners for a Successful Cement Job", World Oil, Oct. 1986.

H. E. Lindsey, Jr. and K. S. Durham, "Field Results of Liner Rotation During Cementing", SPE 13047, 59th Annual Technical Conference and Exhibition, Houston, TX, Sep. 16-19, 1984.

Joe Gibbs, "How to Rotate and Reciprocate While Cementing Your Liner", Drilling-DCW, Jun., 1984.

James L. Cowthran, "Technology Used to Improve Drilling Performance and Primary Cementing Success in Katy Field", SPE 10956, 57th Annual Fall Technical Conference and Exhibition, New Orleans, LA, Sep. 26-29, 1982.

Kyle S. Graves, "Planning Would Boost Liner Cementing Success", Technology Apr. 15, 1985, Oil and Gas Journal.

Rod Bennett, "Tapered Roller Bearing Enhances Rotating Liner Hangers Performance", Sep. 1985.

FIG. 14
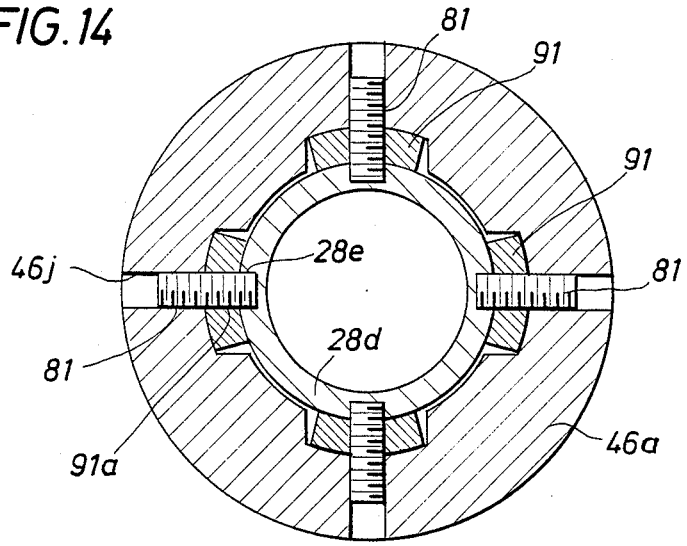
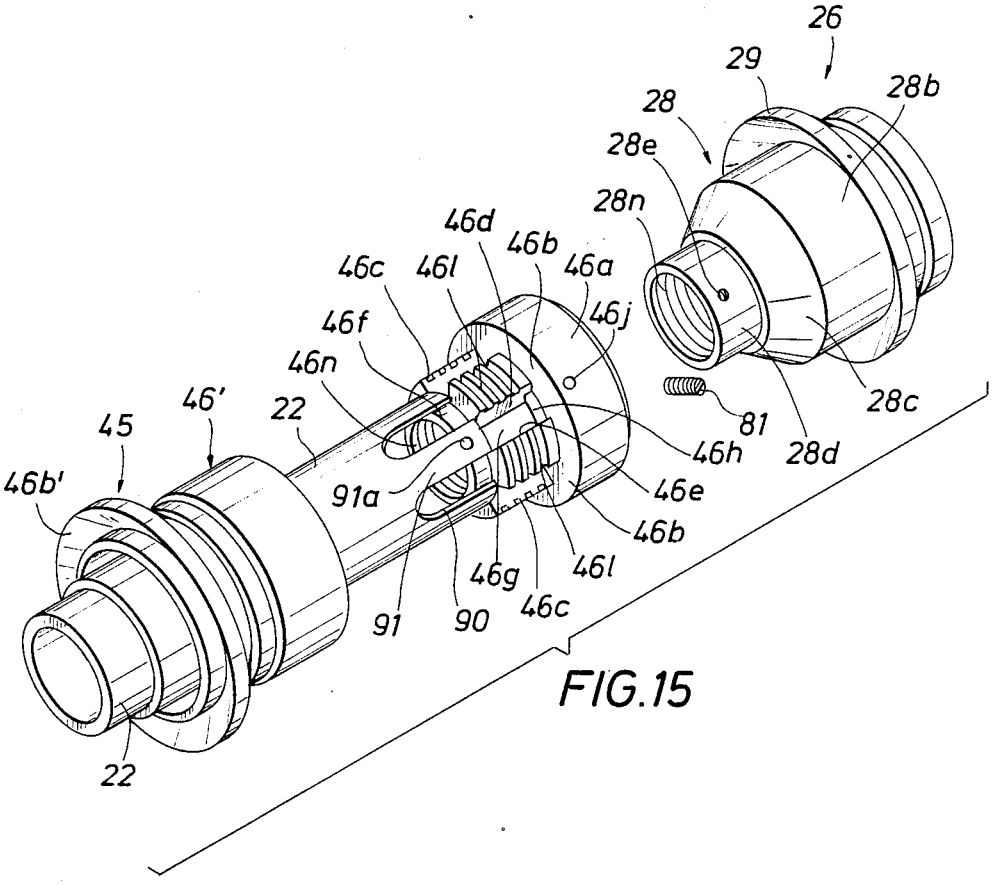
FIG. 15

CEMENTING METHOD AND ARRANGEMENT

CROSS REFERENCE TO RELATED APPLICATIONS

This application is a continuation of prior application Ser. No. 07/147,701 filed on Dec. 4, 1987 and now abandoned for "CEMENTING METHOD AND ARRANGEMENT" which was filed as PCT International Application Ser. No. PCT/US 87/01924 on Aug. 12, 1987.

STATEMENT OF THE PRIOR ART

Where a tubular member forms an extension of a sheath in an opening, such as for example, a liner which is secured to a casing in a well bore and extending therefrom, it is generally accepted practice to seal around the liner in the opening or well bore and adjacent the lower end of the sheath or casing with cement or any other suitable substance. Such operation is generally referred to as single stage cementing to distinguish from those situations in which cementing operations are conducted in more than one stage or sequence.

It is preferable that in such cementing operations the cement which is provided to the cement region in the opening, or well bore be isolated as it is conducted through the opening or well bore to the cementing region to avoid contamination by other fluids in the opening or well bore to obtain a uniform consistency of cement and hence a better cement protective sheath in the cementing region.

To accomplish such isolation, various plug and wiper arrangements have been proposed and used such as shown in U.S. Pat. Nos. 3,364,996; 3,635,228; and 4,671,358, however, it is believed that possible malfunction of the above present state of the art, as known to applicant, could cause problems in cementing operations.

For example, if the plug and wiper means do not operate in proper sequence to isolate both ahead of and behind the cement as it is conducted through the operating string into the opening or well bore, contamination may occur. Also, premature release between the wiper means and its respective engaged plug means as they move through the operating string and the liner to discharge the cement from the liner for cementing the liner in the well bore may cause contamination of the cement. The seals associated with the wiper means may not properly contact the operating string or the liner so as to possibly permit by-pass of cement therearound. Contact of the seal means of the wiper means with either the operating string or liner in an improper manner so as to create a substantial back pressure may adversely affect the cementing operation by effecting premature release between the wiper means and its respective plug means, or other possible problems.

To isolate the cement as it is conducted through an operating string to the cementing region, it is customary to releasably support two spaced plug means with seal means thereon at the earth's surface for release into the operating string for sealing ahead of and behind the cement as it is pumped down the operating string. It is intended that the spaced plug means sequentially and independently engage spaced wiper means releasably supported on the operating string so that the wiper means may be sequentially and independently released from the operating string without effecting release prematurely of the other liner wiper means from the operating string. The spaced liner wiper means and their respective engaged plug means seal ahead of and behind the cement as it is pumped, and discharges, into and through the liner into the cementing region.

U.S. Pat. Nos. 3,364,996; 3,635,288; 4,671,358 typify the prior art as known to applicant. Each U.S. Pat. No. 3,364,996 and U.S. Pat. No. 4,671,358 have reduced diameters in the bore of the second, or upper liner wiper means for receiving the second plug means therein after the first plug and liner wiper means hopefully have been successfully engaged together and released from the operating string by fluid pressure in the operating string. The first, or lower liner wiper means, of each of the U.S. Pat. Nos. '996 and '358 has an extension extending up into the bore of the second or upper liner wiper means and is releasably secured in such bore above the smaller internal diameter seat formed therein for receiving the second plug means.

The Lindsey device of U.S. Pat. No. '358 has collets on the extension of the first wiper means which extend into the bore of the upper wiper means and the extension is secured above the smaller diameter seat contact or engage the reduced diameter on the second wiper means after release of the lower wiper means. The collets are supposed to collapse inwardly, by such contact with the seat in the bore of the upper wiper means to enable the extension to move past and out of the bore of the upper wiper means. Similarly, the extension of Brown's U.S. Pat. No. '996 first liner wiper means must clear the smaller diameter shoulder 36 in the bore of the upper liner wiper for the lower liner wiper means to successfully and independently release.

Contaminants in the fluid in the operating string ahead of the cement or other factors may prevent unrestricted movement of the first wiper means extension through such smaller diameter portions in the second wiper means, thus possibly causing premature release of the second liner wiper means at the same time as the first or lower liner wiper means is attempting to release from the operating string and the second, or upper wiper means.

Also, the inwardly projecting fingers 50 of Brown may interfere with proper seating of the second plug on shoulder 36 in the bore of the second wiper means.

In Lindsey and Brown, the above patents, the first lower liner wiper means is releasably secured with the first plug engaged therewith but there is no arrangement to lock them in such relationship until they reach a predetermined location in the liner. Thus, a malfunction, such as increased pressure in the operating string may prematurely release the first plug from the first or lower liner wiper means prematurely which is undesirable. Also, such arrangement does not provide a safety back pressure means in addition to the set shoe or a float collar that may be normally provided in a liner cementing operation.

U.S. Pat. No. 3,635,288 also shows a lower wiper means which extends through the upper wiper means to enable it to be releasably secured by the shear pins 20 above the lower end of the upper wiper means and above the seal means on the upper liner wiper plug. However, there is no reduced restriction in the bore of the upper wiper means as there is in the Brown or Lindsey patents.

U.S. Pat. No. 3,635,288 provides external catching means to hopefully catch the upper plug means 114 so it may sealably engage with the upper liner wiper means for release with the upper liner wiper means by pressure in the operating string thereabove. However, such device must function in the hostile environment in the well bore which may be several miles deep in the earth and there is no assurance that the device will function safely and properly in such hostile environment.

SUMMARY OF THE INVENTION

The present invention provides a construction wherein the operating string extends through the second or upper wiper means and terminates in overlapping relation with the first, or lower wiper means for releasably securing with the first or lower wiper means. This provides a construction wherein the lower wiper means is secured below the smallest internal diameter that may be present in the upper wiper means to assist in preventing premature release of the upper means. It also enables the longitudinal bore of the lower wiper means to originate and extend away from adjacent the lower end of the upper wiper means rather than providing an extension with a bore that extends up into the upper wiper means, thus inhibiting premature release of the upper wiper means when the lower wiper means is released from the operating string. It further provides an arrangement wherein an initial movable seal is formed with only the operating string when the upper plug is engaged with the upper wiper means rather than the bore of the upper wiper means. It contemplates a construction wherein the upper wiper means is provided with a portion extending through the operating string and into the bore thereof which provides a seat for engaging the upper plug means with the upper wiper means, but the lower wiper means is secured below such restriction to avoid hanging upon the seat and causing premature actuation of the upper wiper means. It further provides a means for releasably securing the first or lower wiper means to the operating string adjacent the lower end of the second, or upper wiper means and below the second or upper wiper means to assist in proper and independent release sequencing of the engaged lower wiper means and its plug as well as the upper wiper means and its plug.

Another object of the present invention is to provide means for locking the lower wiper means with its plug means as they sealably move through the liner to a predetermined position to prevent premature release of the lower wiper means from its plug and premature release of the cement therebehind until the wiper means is seated at the predetermined position. Such construction also provides an additional backpressure safety valve to prevent reverse flow into the liner in addition to the set shoe normally associated with the liner.

Yet a further object of the present invention is to provide an arrangement for locking or latching a lower wiper means and its plug in position is the liner so that the upper wiper means and its plug may be locked or latched thereto after they have performed their function to assist in milling or drilling the wiper means and plug means out of the liner at the completion of the cementing operation.

The present invention provides a method for cementing the liner wherein seal means seal between the liner and operating string and the liner can be positioned for supporting or hanging on the casing. Plug means with seal means thereon assures proper sequencing to seal with the operating string ahead of and behind the cement and engaging with the corresponding wiper means to effect release of the wiper means from the operating string and each plug and its wiper means jointly form a movable seal as they sealably move ahead of and behind the cement as the cement or sealing fluid moves through the liner to the cementing region. The liner support means includes means for hydraulic or mechanical actuation and may include one or more liner hangers and where multiple hangers are used means are employed for simultaneously setting all of them to distribute the load of the liner thereamong. The support means also includes means for rotating or reciprocating the liner before setting, and rotating after the setting the liner in the well bore casing.

Other objects and advantages of the present invention will become readily apparent from a consideration of the following drawings and description.

BRIEF DESCRIPTION OF THE DRAWINGS

FIG. 14 is a sectional view on the line 14—14 of FIG. 6 illustrating one form of the releasable means for releasably securing the first or lower wiper means and second or upper wiper means with the operating string in accordance with the present invention;

FIG. 15 is an exploded view illustrating in greater detail the relationship of the lower end of the operating string and the manner of releasably securing the first and second liner wiper means by the releasable means embodiment illustrated in FIGS. 1–14 to the operating string;

DESCRIPTION OF THE PREFERRED EMBODIMENTS

Figure 1:
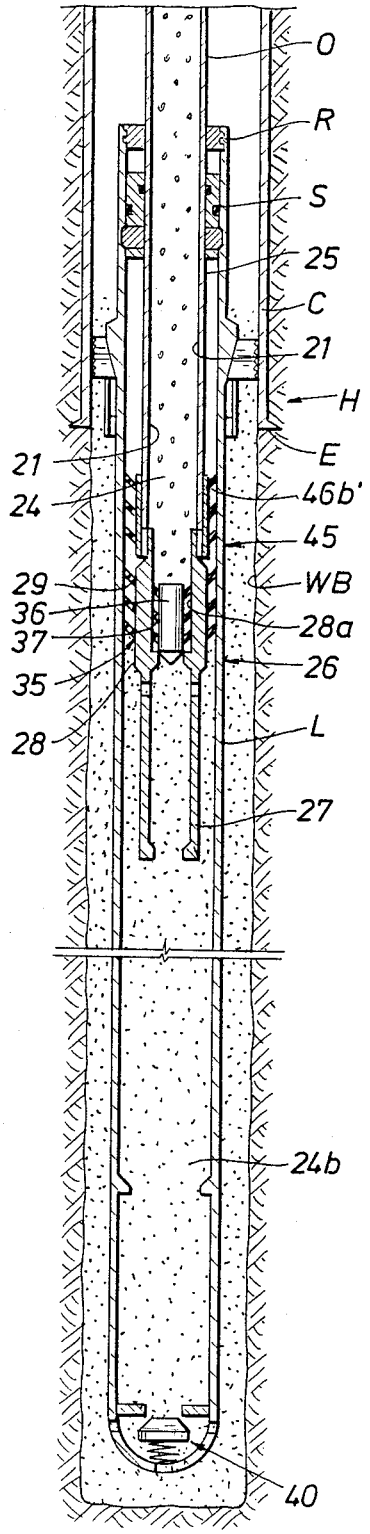
FIGS. 1–5 inclusive are schematic illustrations of an operating string releasably and sealably secured with a liner in a well bore casing and demonstrating the sequential actuation of the separate plug and wiper means for isolating cement as it is conducted through the operating string and liner to a cementing region in a well bore and sealing off the lower end of the liner against backflow from the well bore.

Attention is first directed to FIGS. 1–5 inclusive of the drawings wherein a well bore annulus is represented by the letters WB having a casing C therein terminating as represented at E in the well bore WB. An operating string such as a drill string or tubing string extends from the earth's surface and is represented by the letter O and has a portion which may be referred to as a tail pipe 25 which extends through the seal means S and seals between the operating string O and the liner L and the releasable means R which releasably secures the operating string O and the liner L together for lowering into the well bore WB and for conducting operations to position the liner L therein as will be explained.

A first wiper means, or lower liner wiper means is schematically illustrated at 26 and a first or lower pump down plug means is schematically illustrated at 35 as engaged within the bore 28*a* of body 28 of the first wiper means 26. Seals 29 are mounted on body 28. The first pump down plug means includes a solid or closed plug body portion schematically represented at 36 with annular seals 37 projecting therefrom for sealably engaging with the bore 21 of the operating string O to form a movable seal in the operating string O ahead of the cement and any cleaning or conditioning fluid that may precede the cement for conditioning of the well bore prior to discharge of the cement into the cementing region. The first wiper means 26 and first plug means 35 when secured or engaged together by pressure in the operating string O releases the wiper means 26 from the operating string to form a movable seal means for moving ahead of the cement as they move through the liner L. Thus, such arrangement enables the plug means to first wipe the operating string O ahead of the cement, and any cleaning fluid which precedes it, and then after the first wiper means 26 has been released from the operating string O, as will be described, it and the first plug means move through the liner L and form a movable seal with the bore wall of the liner which enables the liner walls to be also wiped prior to discharge of the cleaning fluid and cement thereinto.

Figure 4:
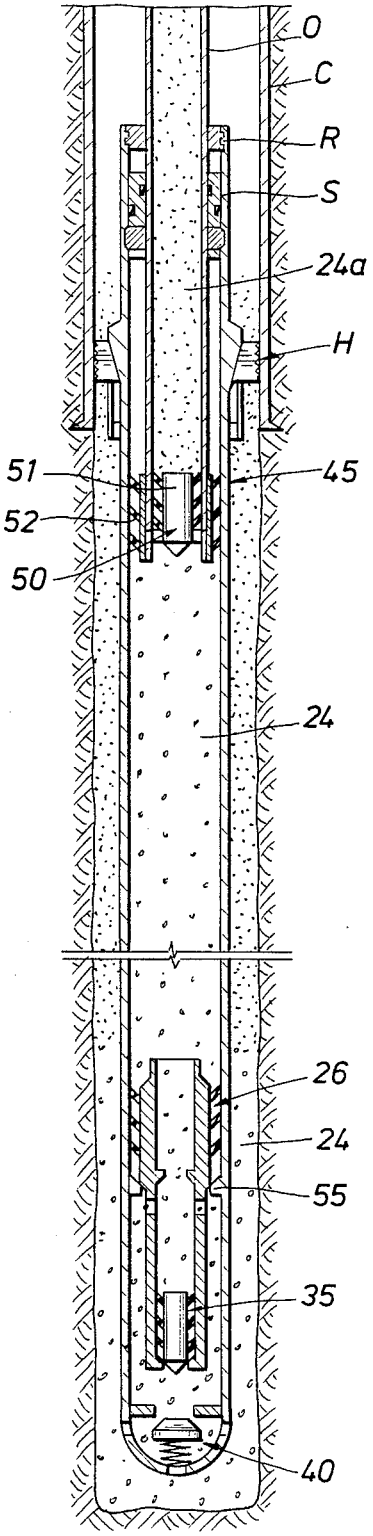

Second or upper liner wiper means is schematically illustrated at 45 with seal means 46*b*spaced longitudinally along body 46. The second liner wiper means is also releasably secured with the operating string O. As shown in FIG. 4 a second or upper cement plug schematically represented at 50 includes a closed or solid plug body 51 and seal means 52 of similar configuration or of suitable configuration generally similar to that described with regard to plug means 35 to seal with the bore of the operating string O behind the cement represented at 24. When the second or upper plug means 50 engages in the second or upper liner wiper means 45 as illustrated in FIG. 4, they are then released together from the operating string O by the pressure therein to form a movable seal in the liner L behind or above the cement. It can be appreciated as the second plug means 50 moves through the operating string to seat in the upper wiper means 45, it will wipe the bore of the operating string O and in turn it and the upper wiper means wipe the interior wall of the liner L as they move therethrough.

In some instances the first plug means 35 and first wiper means 26 may move downwardly and latch with the catcher means 55 before release of the second wiper means 45 and the second plug means engaged therewith from the operating string, depending upon the volume of cement between the spaced movable seals that is to be discharged to the well bore annulus WB exteriorly of the liner.

It will be noted that the liner L is normally provided with a one-way acting valve means represented generally at 40 adjacent its lower end to prevent backflow from the well bore annulus WB. As illustrated schematically in FIG. 3 lock means 60 associated with the first liner wiper means 26 and first plug means 35 has been actuated to release plug means 35 from the first wiper means 26 for communication through the ports P in the extension 27 of the first liner wiper means 26 below catcher means 55 to enable the cement behind the first plug means 26 and engaged wiper means 35 to communicate through the liner L and out the back pressure valve 40 into the well bore annulus WB. It will be noted in FIG. 3 that this has occurred prior to release of the upper wiper means 45 from the operating string O. However, in some instances such relationship may not be established until after release of the first wiper means depending upon the volume of cement to be discharged.

Figure 2:
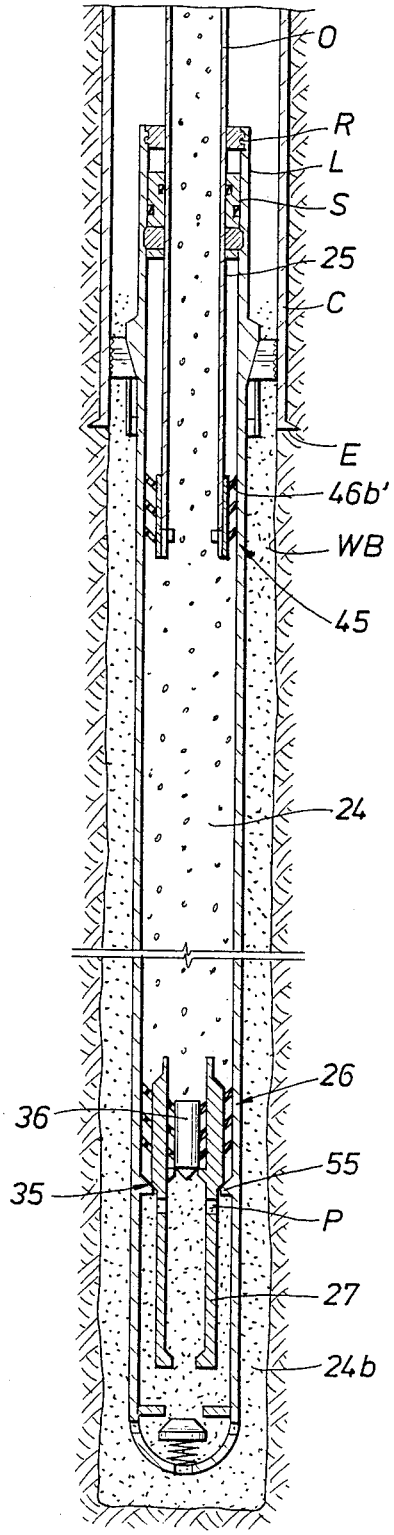
Figure 3:
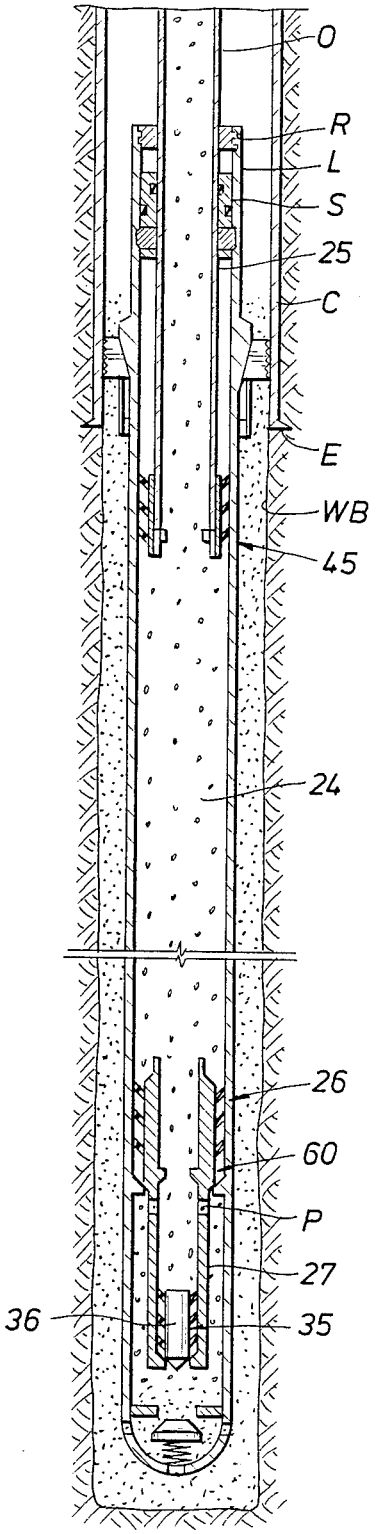
Figure 5:
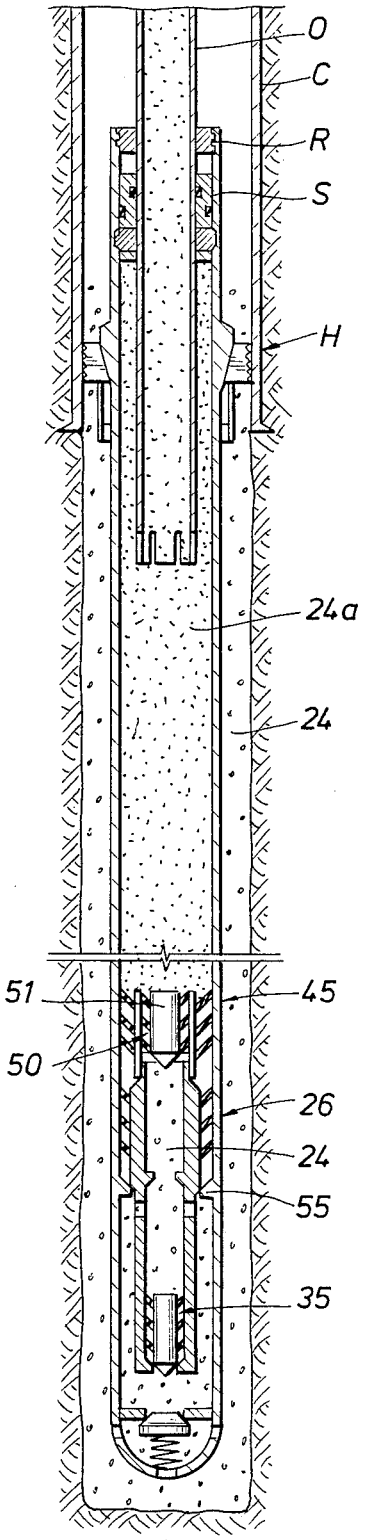

The upper wiper means 45 and engaged second plug means 50 form a movable seal which seals behind or above the cement represented at 24 to separate it from the fluid represented at 24a in FIGS. 4 and 5 in the operating string O and liner L behind the engaged second wiper means 45 and plug means 50. In a similar fashion the first plug means 35 and wiper means 26 separate the cement 24 therebehind from the fluid portion 24b in the well bore WB and in the liner below the first plug means 35 and first wiper means 26 as illustrated in FIGS. 1–3.

It will be noted that as the cement is pumped down the operating string O, any fluid ahead of first plug means 35 in the operating string will be discharged through the liner L and into the well bore annulus WB ahead of the discharge of the cement from the liner. As noted previously, cleaning or other well bore conditioning fluid may precede the cement immediately behind the first plug means 35 and the first wiper means 26 when they are engaged and released for movement through liner L.

After movement of both the first wiper means 26 and its plug means 35 and second wiper means 45 and its plug means 50 through the liner the upper wiper means 45 engages and latches with the first wiper means that has been previously latched to catcher means 55 as schematically illustrated in FIG. 5. This forms a back-up one-way acting valve to prevent reverse flow from the well bore adjacent the liner L into the liner. Such arrangement also facilitates drilling or milling the first and second wiper means to remove them from the interior of the liner L.

The positioning means includes hanger means represented generally by the letter H as well as other components that will be described which enable the liner L to be positioned and suspended or hung on the casing as schematically represented in FIGS. 1–5.

Figure 6:
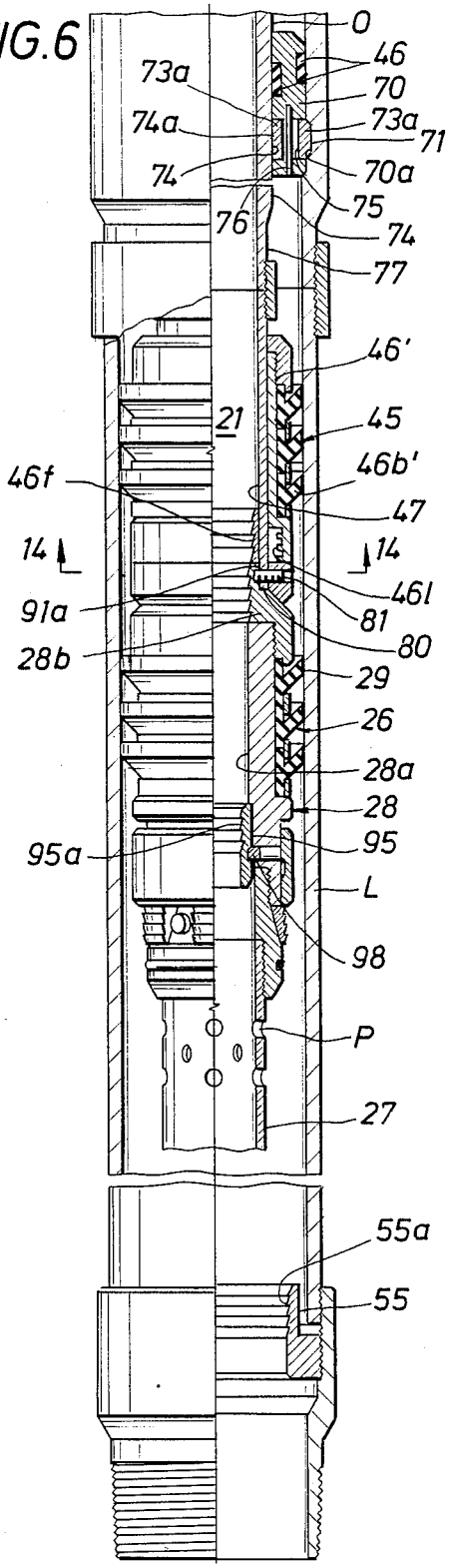
FIG. 6 is a longitudinal sectional view partly in elevation of the upper portion of a tool illustrating a form of the component relationships of the present invention with seal means between the liner and the operating string with which it is secured as well as the upper and lower wiper means releasably secured with the operating string at substantially the same transverse and circumferential position.

The seal means S may be of the conventional drillable or swab cup type packer form or may assume the retrievable form illustrated in FIG. 6 wherein body means 70 are provided with seal means 46 for engaging the interior of the liner and the exterior of the operating string for sealing therebetween.

Cooperating surface means on the liner L in the form of an annular recess or profile 71, the annular surface 74 on the operating string and the exterior annular surfaces 70a, 74a on the movable members or projecting lugs 73a mounted in circumferentially spaced windows of the body 70 cooperate to engage and lock the body means 70 to the liner L to maintain a seal between the liner L and the operating string O while accommodating movement of the operating string relative thereto. A pin 76 in enlarged passageway 75 in lugs 73a accommodate lateral movement of the lugs laterally of the body 70.

Means to unlock the cooperating surface means are provided in the form of the smaller annular diameter portion 77 on the operating string which, upon further relative longitudinal movement between the operating string and body means 70 align the smaller diameter portion 77 on the operating string with the projection or lugs 73a to accomodate their retraction from the recess 71 so that the seal means S may be retrieved from the well bore WB along with the well string.

It will be noted that the operating string O extends substantially through the bore 47 of the second or upper wiper means 45 and terminates in overlapping relation as represented at 80 in relation to the first or lower wiper means 26 as more clearly seen in FIG. 6.

Also, the second wiper means 45 includes a body referred to at 46' on which are disposed a plurality of flared or projecting and longitudinally spaced seal members 46b' for sealably engaging with the interior of the liner. The operating string O extends through the longitudinal bore 47 of the second wiper means 45 as previously stated and enables the first wiper means 26 to be releasably secured to the operating string O in a manner to avoid premature release of the second wiper means 45 when the first wiper means 26 is independently first actuated to release from the operating string and then move, along with its engaged plug means 35 through the liner as described heretofore in connection with FIGS. 1–5.

The first or lower liner wiper means 26 also includes a body 28 on which are arranged flared and longitudinally spaced seal means 29 for sealably engaging with the interior of the liner wall. The wiper means 26 includes a bore 28a therethrough in which seat 95 is provided for receiving the first plug means 35.

Figure 8:
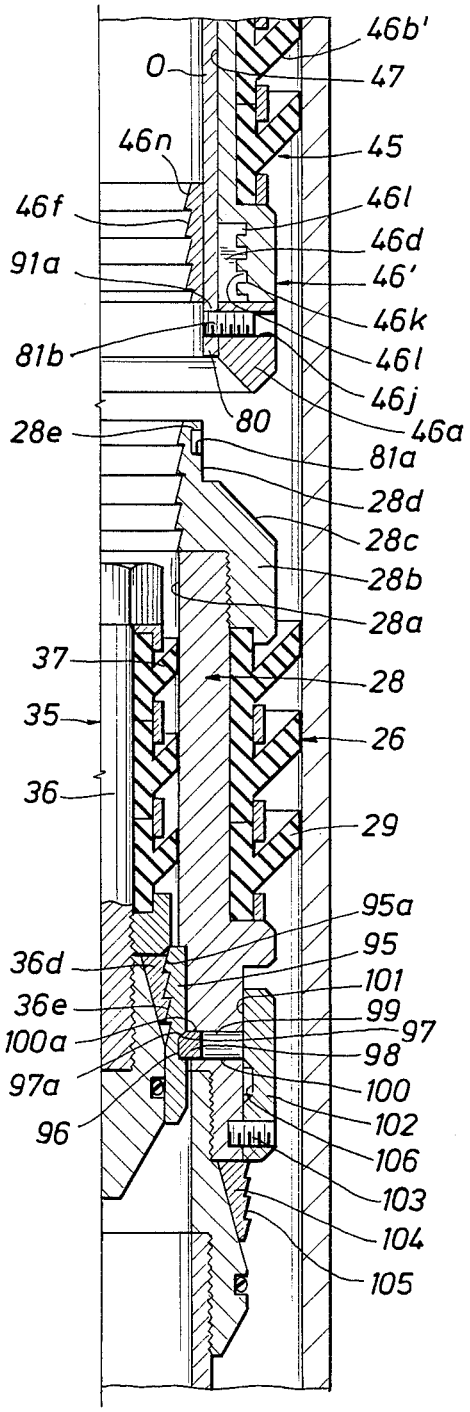
FIG. 8 is a partly enlarged sectional view enlarged to show in greater detail the sealing and locking relationship between the first or lower plug means and first or lower liner wiper means and its sealing relationship with the liner, as well as showing the relationship of the first, or lower liner wiper means to the lower end of the second or upper wiper means immediately after the first wiper means is released from the operating string adjacent the lower end of the second or upper liner wiper means.

The first plug means 35 illustrated in greater detail in FIG. 8 includes a solid body 36 on which are mounted flared or projecting and longitudinally spaced annular seals 37 for initially sealably engaging with and wiping the interior of the operating string as it is pumped there through to seat within the first wiper means 26 as shown in FIG. 8 whereupon it forms a seal with the bore 28a extending through the first wiper means 26.

Figure 11:
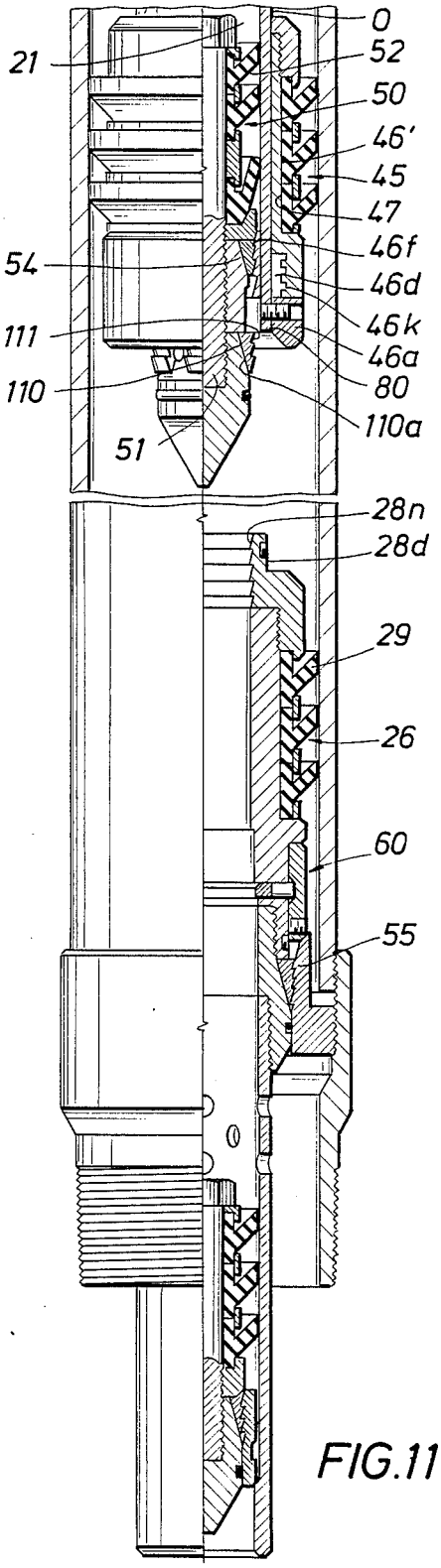
FIG. 11 is an enlarged sectional view partly in elevation illustrating the second plug means in sealing relationship with the operating string and seated, and engaged with the second or upper liner wiper means.

The second or upper pump down plug means 50 also includes a solid body portion 51 shown in FIG. 11 on which are mounted flared and longitudinally spaced seal means 52 which initially seal with the operating string O as it is pumped through the bore thereon and thereafter seals with the portion of the operating string which extends through the second wiper means 45 as shown in greater detail in FIG. 11 when the plug means 50 is engaged on the seat 46f forming part of the second wiper means 45 within the bore of the operating string O.

The seal members 46b', 29, 37 and 52 may be of different diameters for sealing with different diameter tubular members as they move therethrough.

In the embodiment illustrated in FIGS. 6–15 inclusive, the releasable means which is shown in the form of frangible or shear pin means 81 for releasably securing both the first wiper means 26 and second wiper means 45 on the operating string is arranged substantially in the same circumferential position and at substantially the same transverse relation with respect to the longitudinal axis of the operating string as illustrated in these view in the drawings.

In FIG. 15 the lower end portion 22 of the operating string is illustrated and has adjacent its end longitudinally extending slots or recesses 90 forming the longitudinally extending projections 91 therebetween.

The upper end cap 28b of body 28 of the first or lower wiper means 26 is illustrated on the right hand end of exploded FIG. 15 with one of the seals 29 on body 28. The body 46' of the upper wiper means 45 has a lowermost end portion 46a shown approximately the middle of FIG. 15. The lowermost end portion 46a is shown as having an annular shoulder 46b from which extend annular threaded and circumferentially spaced segments 46c which have longitudinal side surfaces 46d, 46e. The threaded segments are in turn part of the annular smaller diameter portion 46f which projects longitudinally beyond the threaded segments 46c. The recessed surfaces 46g which extend longitudinally between the segments 46c terminate at 46h in radially spaced relation to the shoulder 46b to provide spaced circumferential openings in the upper wiper means 45 as seen more clearly in FIGS. 8 and 10–15 inclusive. The recessed surfaces 46g and side surfaces 46d and 46e are adapted to slidably receive the circumferentially spaced projections 91 on the lower end portion 22 of the operating string O as more clearly seen in FIGS. 8 and 10–15 inclusive. When the components illustrated in exploded relation of FIG. 15 are assembled the smaller diameter portion 46f is inserted in the lowermost end of portion 22 of the operating string so that the projections 91 thereof are received within the recesses formed by surfaces 46g, 46d and 46e to align shear pin openings 91a in each projection 91 with a corresponding shear pin opening 46j in end portion 46a as more clearly seen in FIGS. 6, 7 and 14. Body 46' is provided with internal threads 46k (see FIG. 8) for engaging with threads 461 on the segments 46c so that end portion 46a is thus secured with the remainder of body 46'.

The end cap 28b of the first or lower wiper means body 28 includes an annular, inwardly inclined surface 28c with reduced annular portion 28d extending therefrom as shown in FIGS. 15 and 8. Shear pin recesses (one shown) 28e are provided in end cap 28b.

Figure 7:
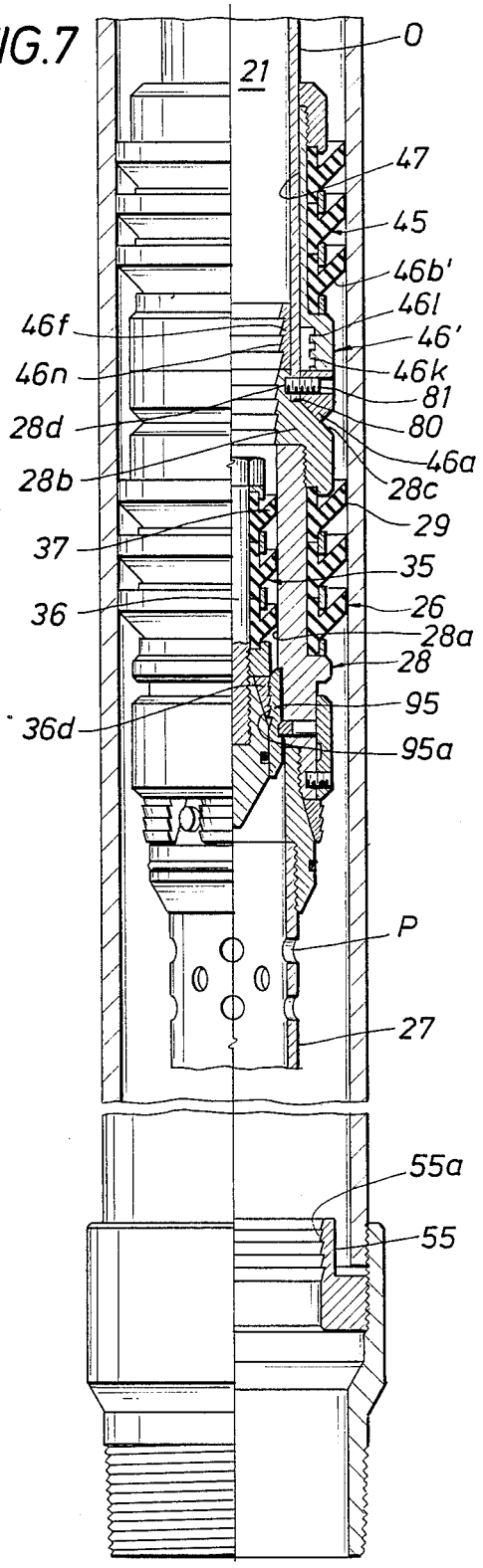
FIG. 7 is a sectional view partly in elevation and is a continuation of the apparatus of FIG. 6 and illustrating the first pump-down plug means engaged and locked with the first lower liner wiper means prior to release from the operating string.

To assemble the first or lower liner wiper means 26 with the previously assembled second or upper wiper means and operating string, the portion 28d is inserted adjacent and into the operating string lower end to fit adjacent or abut the lower end of 46f as better seen in FIG. 7. The shear pin recesses 28e in 28d are aligned with the previously aligned shear pin openings 91a in projections 91 and 46j in end portion 46a of second wiper means body 46'. Shear pin means 81 is then inserted through openings 46j in 46a; opening 91a in each projection 91 and into recess 28e of portion 28d of end cap 28b of body 28 of the first or lower wiper means 26.

When assembled, the second wiper means body 46' includes the end portion 46a and its integral annular portion 46f which receive the projections 91 on operating string O in the recesses 46g so that portion 46f of the body 46' extends internally of the bore 21 of the operating string O. The portion 46f is provided with the internal buttress threads 46n to seat the second plug means 50 in the bore 21 of the operating string O when the plug means 50 is received in the second wiper means 45, as will be described.

Since the end member 46a and its intergral portion 46f form part of the body 46' of the second or upper wiper means 45, it can be appreciated that the foregoing structural relationship of the operating string O to the upper or second wiper means 45 and lower or first wiper means 26 is such that the operating string extends through the longitudinal bore 47 of second wiper means 45 and terminates in overlapping relation with the lower wiper means 26 for releasably securing with each of them. Also, the portion 46f of the second or upper wiper means 45 provides a portion which extends substantially through the slots 91 of the operating string and into the bore 21 thereof to receive and seat the second plug means 50 for movement of said second plug means 50 and second wiper means 45 together through the liner. The internal bore of the portion 46f which is within the operating string O is configured in any suitable manner to engage and latch with the second plug means 50.

Figure 13:
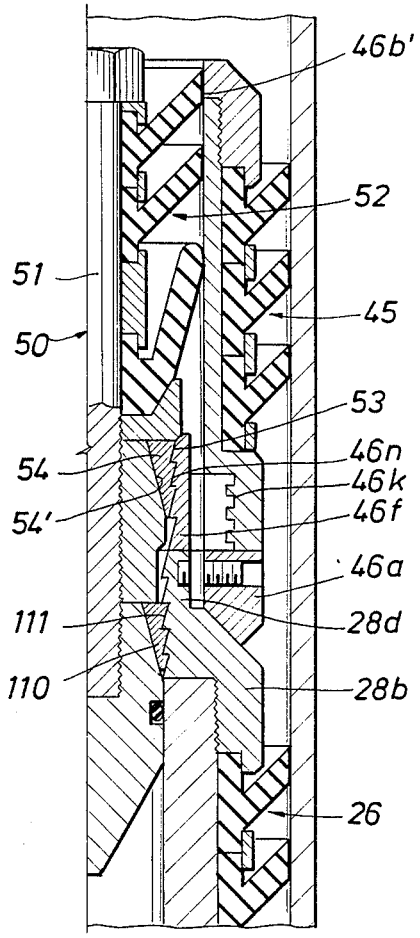
FIG. 13 is an enlarged partial sectional view of the second plug means latched with the second liner wiper means and showing the details for latching the first and second wiper means together.

As shown in FIGS. 13 and 15, a buttress thread arrangement 46n is formed on the internal bore of seat 46f for latching with the buttress threads 53 formed on the outer circumference of the ring 54 on plug means body 51. The ring 54 has a longitudinal groove there through to accommodate flexing thereof on its tapered seat 54' on body 51 as such ring moves into latching relationship with seat 46f.

The separate seal or wiping elements provided on each the first and second wiper means and the first and second plug means can be of any suitable form and figuration and as illustrated are a plurality of separate wiper or seal means which are retained on the respective body means of the wiper and plug means by any form of retainer means as illustrated in the drawings.

Figure 9:
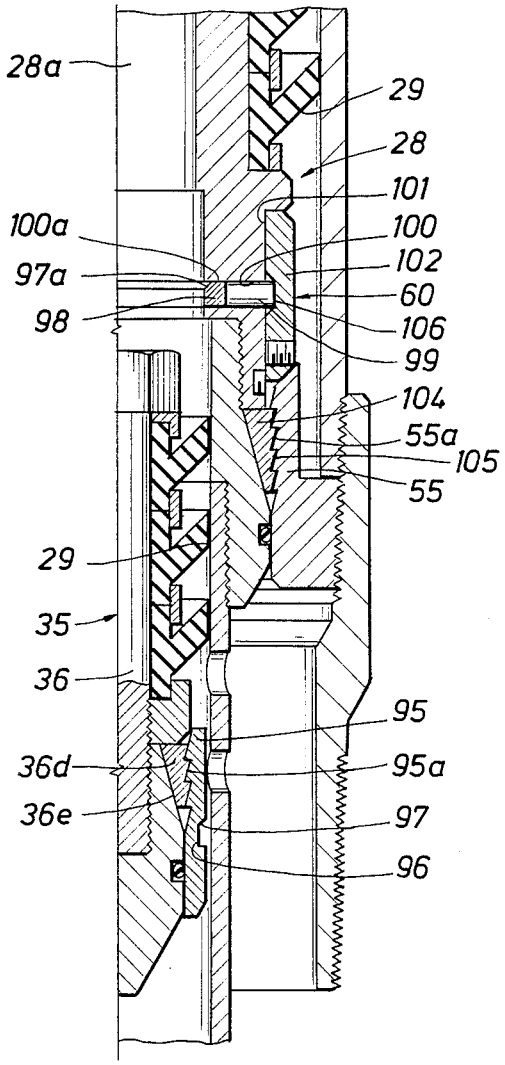
FIG. 9 is an enlarged partial sectional view illustrating in greater detail the catcher means for receiving and latching with the first wiper means with the lock means unlocked and actuated enabling the first plug means to release from the first wiper means for movement longitudinally thereof to accommodate communication of the cement from the liner above the first wiper means and plug means to the cementing region.

The lock means 60 for the first plug 35 and wiper means 26 is shown in enlarged detail in FIGS. 8 and 9. The first or lower wiper means 26 is provided with an annular collar or seat 95 releasably locked in its internal bore 28a by ring 98 in groove 100a. Buttress threads 95a are provided on the internal diameter of the collar 95 for latching with the ring 36d carried on the tapered seat of first plug 35. The ring 36d also is split longitudinally to accommodate flexing and is provided with buttress threads 36e for engaging with the buttress threads 95a of the collar 95 in the first wiper means 26. The seat 95 is provided with an annular groove 96 which has a taper 97 at its upper annular side as shown. The split ring 98 is configured to conform with and be received in the groove 96, and its inner, upper annular edge is tapered at 97 to conform with taper 97 on groove 96. The ring 98 is split to accommodate flexure thereof and retainer pins 99 extend through circumferentially spaced radial openings 100 which terminate in the annular groove 100a of body 28 of the first wiper means. The ring 98 is dimensioned to also partially rest in annular groove 100a in which the inner ends of the openings 100 terminate. The retainer pins inner ends therefore abut the outer circumference of ring 98 and the outer end of the retainer pins 99 abut the inner annular surface 101 of collar 102 when the collar 102 is retained in the position shown in FIG. 8 by the shear pin 103 engaging it and body 28.

From the foregoing it can be seen that after the first plug 35 latches with the first wiper means 26 and the inner end 81a of shear pin 81 sheared as shown in FIG. 8, this enables the first wiper means to release from the operating string O as shown in FIG. 8. The collar 102 abuts the outer ends of the retainer pins 99 to lock ring 98 in the relationship shown in FIG. 8 and thus secure or lock the first plug means 35 with the first or lower wiper means 26 against premature release as they both move through the liner L ahead of the cement.

Figure 10:
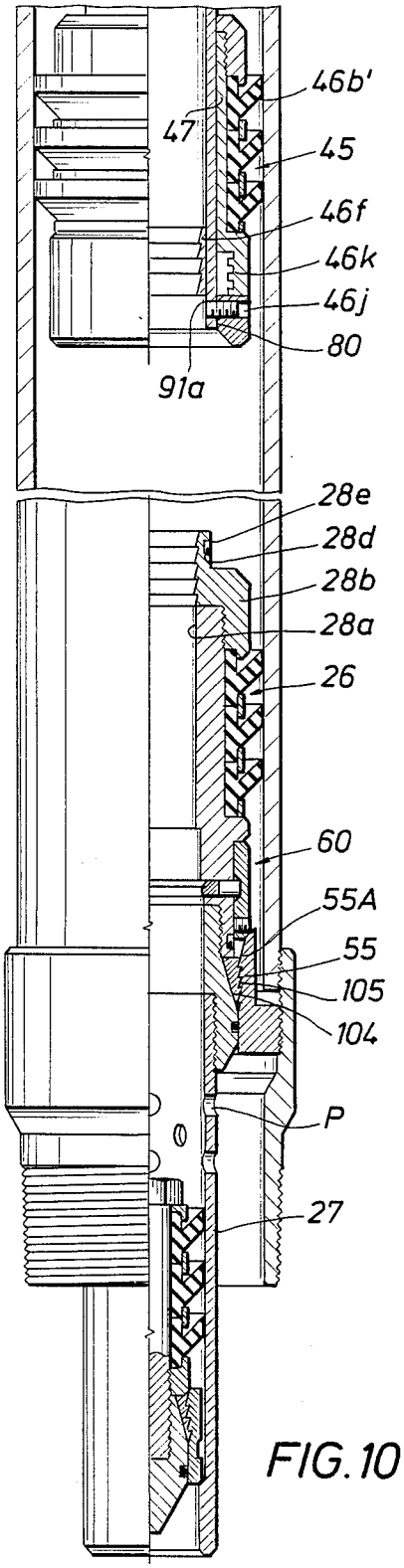
FIG. 10 is an enlarged sectional view partly in elevation demonstrating the first plug means after release from the lower wiper means and adjacent the lower end of the lower liner wiper body bore with communication opened to the liner for discharge of the cement from above the first wiper means.

The first plug means 35 and first wiper means 26 will remain locked together as shown in FIG. 8 as they both move through the liner. The lower split ring 104 on the tapered body 28 of the first wiper means 26, as shown in the drawings, FIGS. 9 and 10, is received at the end of the travel within the liner in the catcher means 55 arranged adjacent the lower portion of the liner L. The catcher means 55 has buttress threads 55a conforming to latch with the outwardly facing buttress threads 105 on ring 104 and lock the first plug and wiper means together in catcher 55. When suitable pressure in the operating string is thereafter applied, the pin 103 is sheared.

When pin 103 shears, the collar 102 on the outer surface of the first wiper means 26 can move longitudinally to align internal groove 106 therein with the outer ends of the openings 100 in which retainer pins 99 extend. The internal pressure in the operating string will force plug means 35 down, and due to the tapers 97, 97*a* on the upper groove and ring edge, respectively, the seat 95 of lower wiper means 26 is released from engagement with ring 98 and moves down with plug means 35 and expands ring 98 into the groove 100*a* to force pins 99 radially outward in openings 100 into the annular groove 106 of collar 102. This relationship is shown in FIG. 9. This enables the first plug means 35 to unlock from the first wiper means 26 and move into extension 27 beneath port means P therein to open the liner beneath first wiper means 26 for communicating the liner above the first wiper means to discharge cement from the liner L above the first wiper means 26 to conduct it through one-way valve means 40 to the well bore annulus WB surrounding the liner to initiate cementing the liner in place. The height of the cement in the well bore WB may vary depending on the circumstances.

It can be appreciated that when the first wiper means 26 and its plug means 35 responds to fluid pressure in the operating string to actuate the shear pin 81 only the inner end portion thereof represented at 81*a* in FIG. 8 shears, leaving the remaining portion 81*b* intact so that it remains extended through the operating string O and particularly the projections 91 thereon as well as extending into the port 46*j* in the annular member 46*a* forming part of the second wiper means 45. Thus, the second wiper means 45 remains intact and releasably secured on the operating string O after the first wiper means has been released therefrom.

When the second plug 50 moves into the bore 47 of the second wiper means 45, through which the operating string extends, and engages and latches with seat 46*f* on the second wiper means, pressure in the operating string may be increased to shear the remainder 81*b* of the shear pin and release the second or upper wiper means 45 and the second plug engaged therewith from the operating string O. It is to be noted that when the second plug means 50 is engaged in the second wiper means 45 the seal means 46*b*' thereon sealably engage initially only with the operating string and it is not until such seals clears the lower end of the projections 91 that they then initially engage within the bore of the second wiper means and seal therewith. The seal means 46*b*' on the wiper means 45 sealingly engage with the interior walls of the liner L and the second plug 50 in bore 47 form a movable seal behind the cement and wipe the cement from the interior wall as they jointly move therethrough along toward the first wiper means 26 latched in the catcher means 55.

Figure 12:
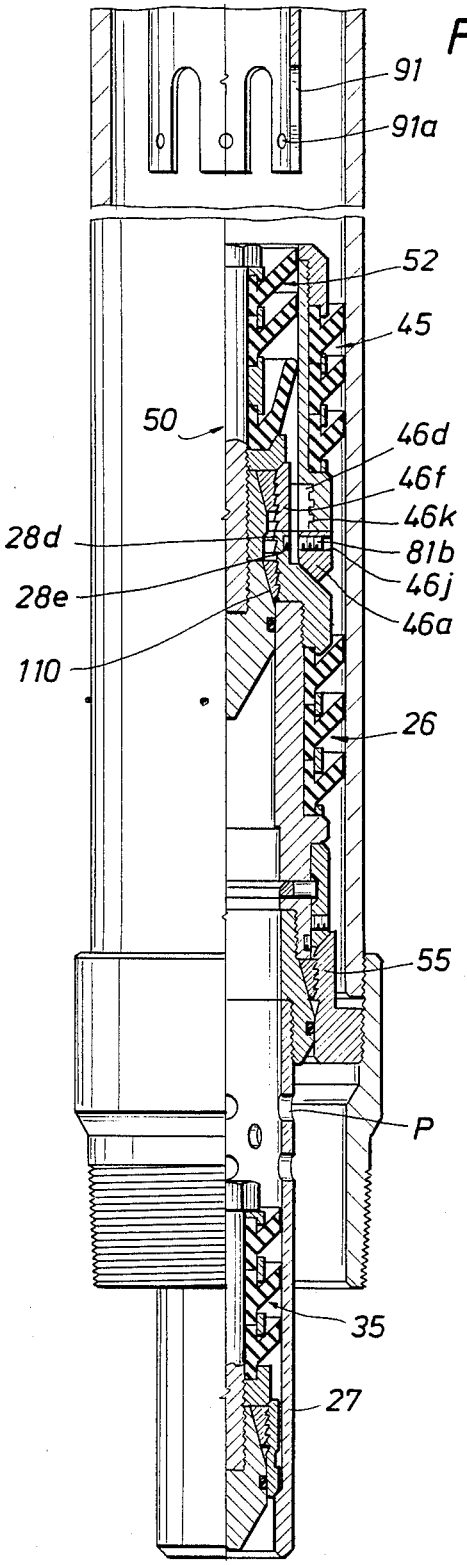
FIG. 12 is an enlarged sectional view partly in elevation illustrating the lower end of the operating string after the second or upper liner wiper means with its plug means in the bore thereof has been released from the operating string and further demonstrating the second or upper liner wiper means and second plug means engaged or latched with the first or lower wiper means in the catcher means to retain them as a unit.

The second plug means 50 is provided with a lower split latch ring 110 which is spaced from the latch ring 54 and its tapered seat as shown in FIG. 11 of the drawings. It is provided with the external buttress threads 111. The portion 28*d* of the first wiper means 26 is provided with internal buttress threads 28*n* as illustrated in FIG. 11 for receiving and latching with the ratchet threads 111 on the latch ring 110 adjacent the lower end of the second plug means 50 as shown in FIG. 12 of the drawings. The ring 110 is also on a tapered annular surface 110*a* of the second plug means as is the ring 54, so that flexing of the split rings is accommodated as they engage with seat 46*f* and 28*n* in the bore of 28*d*, respectively. This secures the upper or second plug and wiper means 45 in latched and locked relation to the lower or first wiper means 26 when it is secured in the catcher means 55. This arrangement provides a safety back pressure valve in addition to the set shoe arrangement illustrated in FIGS. 1–5 of the drawings. Also, it enables the wiper plug arrangement to be kept as a unit for milling to remove them from the liner when desired.

As noted with regard to the embodiment just described the structure enables the first or lower wiper means 26 to be secured to the operating string below the upper or second wiper means 45 which eliminates the disadvantage of having any portion of the first wiper means moving through or past any restriction, or smaller internal diameter of the first wiper means. It also enables the bore 28*a* of the first wiper means 26 to originate adjacent and extend away from the lower end of the second or upper wiper means 45 and since the operating string extends through the upper wiper means 45 and terminates in overlapping relation to the lower wiper means 26, the second plug means forms 50 an initial seal only in the operating string O and not in the upper or second wiper means 45 when it is engaged therewith while the second wiper means remains secured to the operating string.

While the second or upper wiper means 45 has a portion 46*f* defining a smaller diameter than the diameter of the bore of the operating string or the bore of the second wiper means 45, the first or lower wiper means 26 is secured below the portion which forms the smallest internal diameter present in the bore of the upper or second wiper means. This avoids or reduces the possibility of the first or lower wiper means hanging up in such restricted diameter which might cause possible premature release of the second wiper means 45 during the cementing operations. It is also noted that the releasable means in the form of shear pin 81 which is shown in FIGS. 6–15 as extending through the second or upper wiper means and terminating in overlapping relation with the first or lower wiper means releasably securing them to the operating sting O is at substantially the same transverse position therein.

Figure 16:
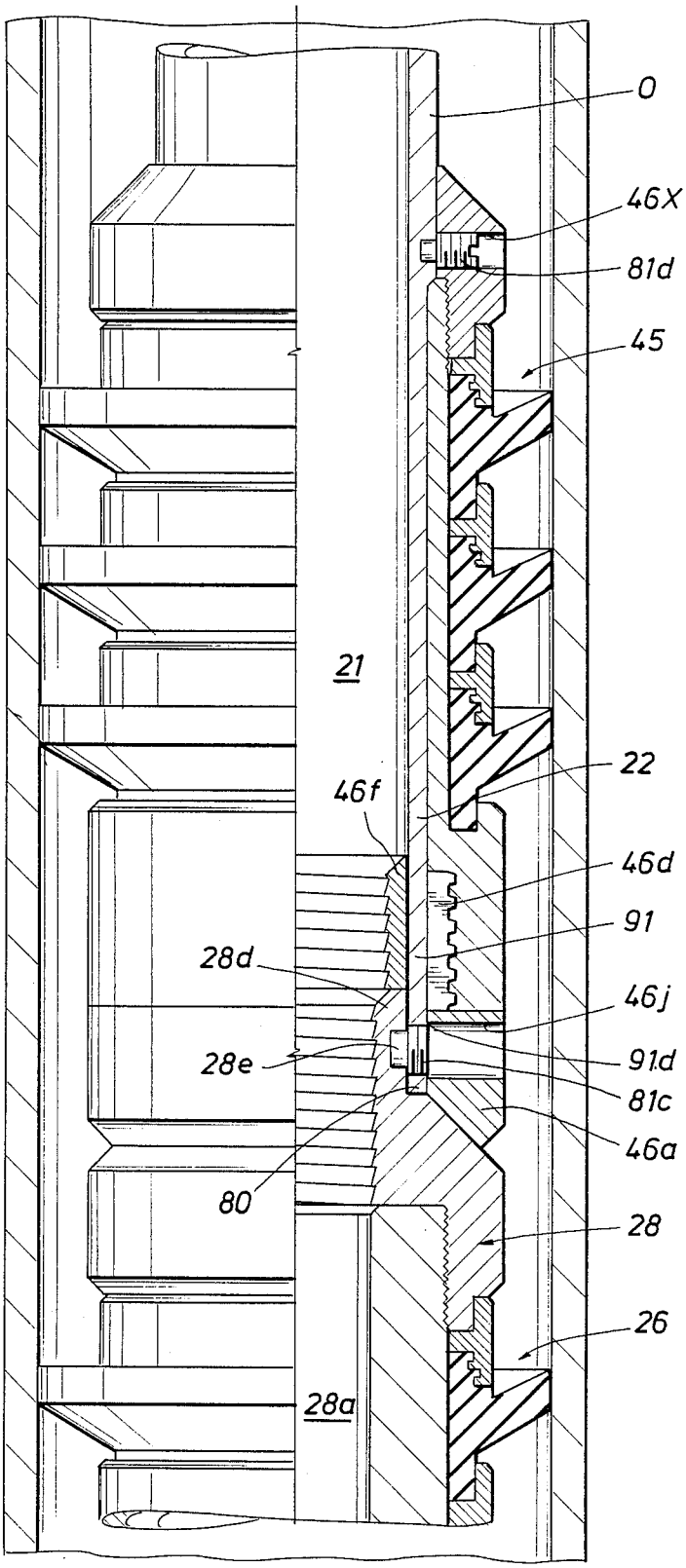
FIG. 16 is a sectional view partly in elevation similar to FIG. 6 and illustrating an alternate arrangement of the releasable means for the second or upper wiper means.

The above advantageous results may also be accomplished with the embodiment illustrated in FIG. 16 wherein like numerals represent like parts. The operating string O is again illustrated as extending through the second or upper wiper means 45 and terminating in overlapped relation relative to the upper end of the lower or first wiper means 26 so that the second wiper means 26 may be secured at its upper end adjacent the lower end of the second wiper means and extend away therefrom. The operating string O and second wiper means 45 is again constructed in the manner as described with regard to FIGS. 6–15 so that the portion 46*f* extends through the operating string O and into the bore 21 thereof. The operating string extends through the upper wiper means and terminates in overlapping relation to the portion 28*d* on the first or lower wiper means 26 as shown in FIG. 16.

The portion 46*a* of the second or upper wiper means 45 is provided with the shear pin opening 46*j* similar to that shown in the prior modification, but in this form the shear pin 81*c* terminates at the outer diameter 91*d* of the projections 91 formed on the lower end portion 22 of the operating string O and extends from this point into the recess 28*e* of the portion 28*d* of the body 28 of the first or lower wiper means 26. Thus, in this embodiment, only the first or lower wiper means is releasably secured to the operating string below the portion 46*f* of the upper or second wiper means 45 which extends through and into the bore 21 of the operating string as described with regard to the FIGS. 6–15 modification.

Another opening 46x is provided in the second or upper wiper means 45 at a longitudinally spaced position in relation to the position at which the first or lower wiper means 26 is releasably secured to the operating string O. Within this opening there is provided a second shear pin 81d which, as are shear pins 81 and 81c, is secured by any suitable means such as threads thereon in the openings in the components in which they extend as well into the recess of the part 28d of the first or lower wiper means 26 so as to releasably secure the second or upper wiper means to the operating string. In FIG. 16 the second or upper wiper means is shear pinned above the seals, but the exact position may vary from this.

The function and operation of this embodiment is the same as that previously described except that separate releasable means are employed for each the first or lower wiper means 26 and the second or upper wiper means 45.

FIGS. 17–20 illustrate further details of the positioning means of the present invention which enable the liner L to be hung or supported on the well bore casing to extend therefrom as schematically represented in FIGS. 1–5 of the drawings. The seal means referred to generally at S is constructed in a manner previously described with regard to FIG. 6.

Figure 18:
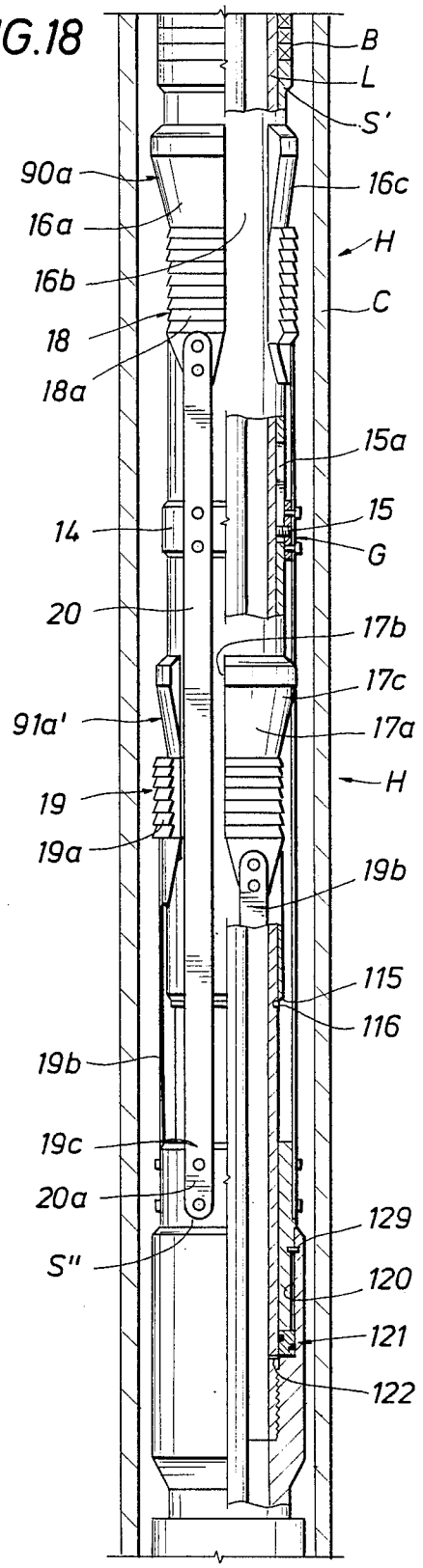
FIG. 18 is a sectional view, partly in elevation, and is a continuation of FIG. 17 showing part of the positioning means for the liner where multiple, longitudinally spaced liner hangers are hydraulically, simultaneously set with bearing means for liner rotation relative to the set hangers.
Figure 20:
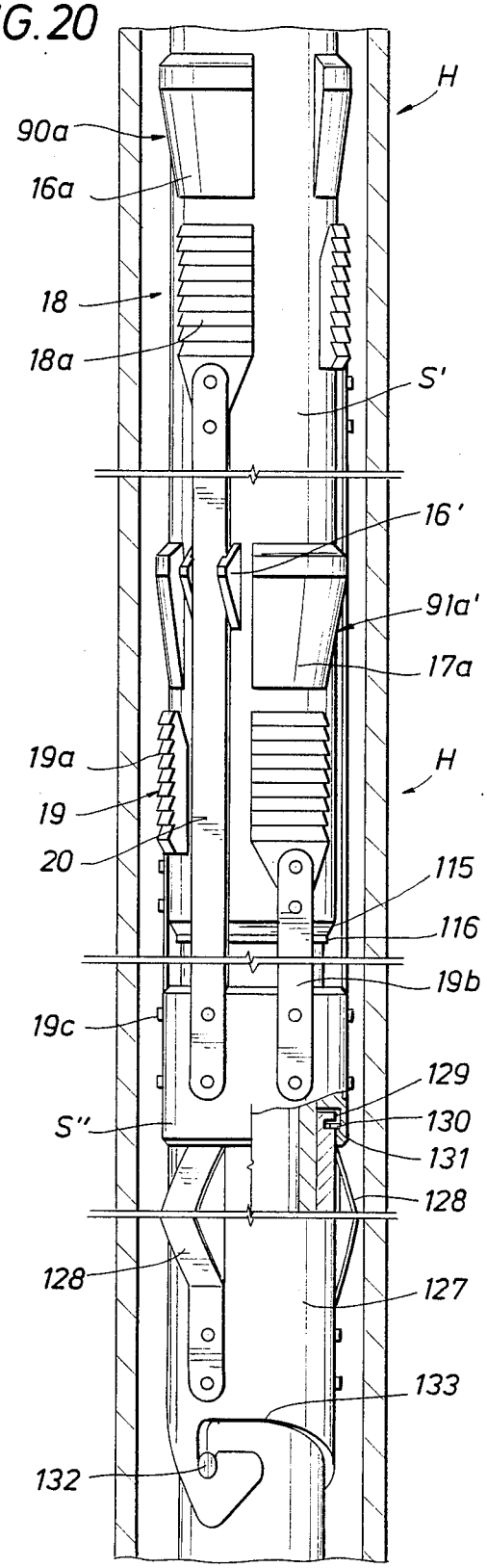
FIG. 20 is similar to FIG. 18 but shows a mechanical arrangement for simultaneously actuating multiple hangers to hang or set the liner on the casing in the well bore for rotating the liner relative to the set hangers.

The hanger means referred to generally at H in FIGS. 18 and 20 are shown in greater detail and in the form illustrated in such views it will be noted that a pair of such hangers are demonstrated. In some circumstances only one hanger H will be employed, while in other arrangements, more than one hanger arrangement H may be employed. Where two or more hanger arrangements are provided, it may be preferrable to simultaneously set such hanger arrangements to distribute the load of the liner among the multiple liner hangers and also under some circumstances it may be desirable to rotate and/or reciprocate the liner in the well bore before hanging the liner L on the casing C to aid in conditioning the well bore as well as rotating the liner either during cementing operations in the well bore or after it has been hung.

The operating string O includes an inner member I having a non-circular mandrel portion M connected between the inner member I and the remainder of the operating string so it will perform its function without interferring with other operations. The liner L represented in FIG. 18 has an outer member Q connected therewith which extends upwardly from the liner L as represented in FIG. 17.

Figure 17:
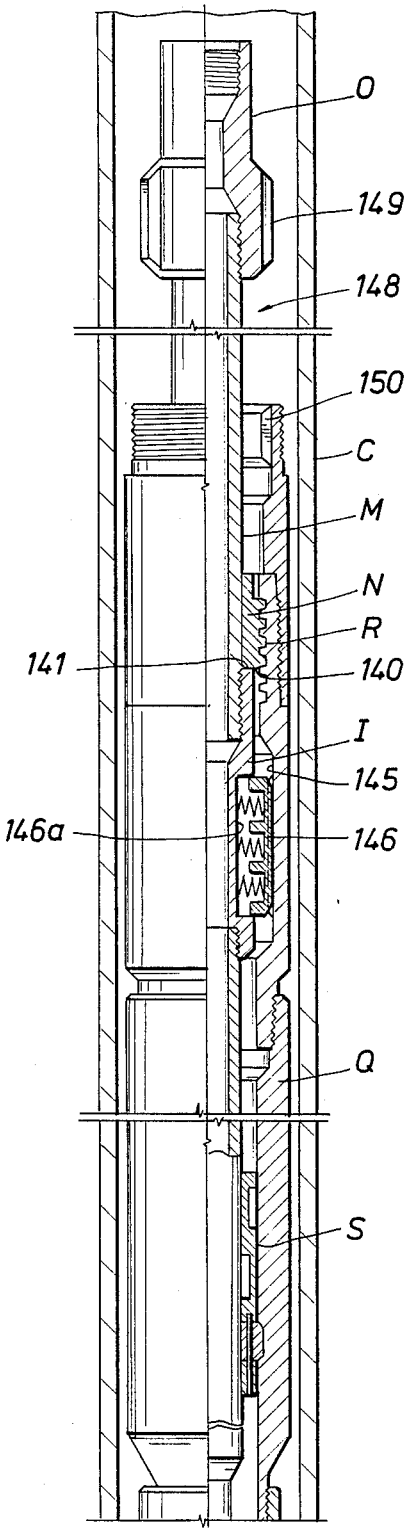
FIG. 17 is a sectional view, partly in elevation, illustrating another embodiment of the upper end of the apparatus shown in FIG. 6 and illustrating one form for use where it is desired to rotate and/or reciprocate the liner where the plug and wiper means of FIGS. 1–16 are employed in cementing operations.

The inner member I and outer member Q are telescopically arranged as shown in FIGS. 17 and 18 and the hanger means H is supported on the liner L for engagement with the casing C to hang or support the liner L on the well bore casing C. The liner hanger arrangements H are in effect part of the liner L since the outer member Q supports the annular bearing means B and the first sleeve means S'. The first sleeve means S' extends longitudinally about the liner a suitable extent and is supported thereon at its lower end 115 by annular ring 116 on liner L or other suitable means for rotation relative to the liner. The first sleeve means S' is provided with upper and lower spaced annular rows 90a and 91a' conically shaped segments 16a and 17a, respectively. The conically shaped segments 16a in the upper row 90a are circumferentially spaced relative to each other by the spaces 16b therebetween and are offset circumferentially relative to the conically shaped segments 17a in the row 91a' of which segments 17a are spaced circumferentially with spaces 17b therebetween. The conically shaped segments 16a and 17a of each row 90a and 91a', respectively, extend longitudinally of the first sleeve means S' and the segments 16a, 17a are provided with outer tapered surfaces 16c, 17c, respectively.

Spaced annular rows of hanger slips 18 and 19, respectively, are formed by the hanger slip segments 18a, 19a, respectively, with the hanger slips 18a in row 18 being offset circumferentially relative to slip segments 19a in row 19. The slip segments 18a in row 18 and slip segments 19a in row 19 are circumferentially spaced from each other to provide circumferential spaces therebetween so that the hanger slips 18a are longitudinally aligned with the conically shaped segments 16a in row 90a and the hanger slips segments 19a are longitudinally aligned with the segments 17a in row 91a'. Means in the form of elongated strips 20 are connected with the hanger slips 18a in row 90a and extend longitudinally of the first sleeve means S' through the spaces 17b between the conically shaped segments 17a in row 17 and the strips 20 are connected at their lower ends 20a by any suitable means to the second sleeve means S'' at 19c.

The sleeve means S'' is spaced longitudinally from the lower end 115 of the first sleeve means S' as shown in FIG. 18.

The longitudinally extending strips 20 may be secured to suitable guide means G which includes the collar 14 connected to the strips 20 between the spaced rows 90a and 91a' of conical segments 16a and 17a by any suitable means such as screws or the like as shown in the drawings. The guide means G also includes projection means 15 on collar 20 fitting in the longitudinal slot 15a of the sleeve S' to assist in maintaining the hanger slips segments 18a in the row 18 aligned with the conically shaped segments 16a in the annular row 90a. In FIG. 20 the guide means G is shown as being in the form of a bracket 16' positioned on the first sleeve means S' to receive the elongated strips 20 and assist in maintaining the slip segments 18a aligned with the conical segments 16a in row 90a.

The slip segments 19a are connected with elongated strips 19b which are also connected to the second sleeve means S'' by any suitable means such as screws 19c or the like as shown.

In the arrangement shown in FIG. 18 the second sleeve means S'' is received within the annular and longitudinally extending recess or chamber 120 formed in the liner which recess is provided with a suitable seal arrangement referred to generally at 121 adjacent the lower end of the second sleeve means S'' within the chamber. It can be appreciated that, if desired, the hanger arrangement may be structured and positioned so that the upper end of the slidable sleeve can be received within the chamber. The seal means 121 forms piston means and when fluid pressure is conducted from the port means 122 in the liner L to act on the piston means 121 formed by the seal arrangement within the chamber 120, second sleeve means S'' is urged upwardly or outwardly of chamber 120 which in turn simultaneously moves the rows of slip segments 18 and 19 respectively toward and outwardly along the inclined surfaces 16c, 17c of the conical segments in the rows 90a and 91a' respectively so that the rows of slip segments simultaneously engage and secure the liner L with the surrounding casing C.

Figure 19:
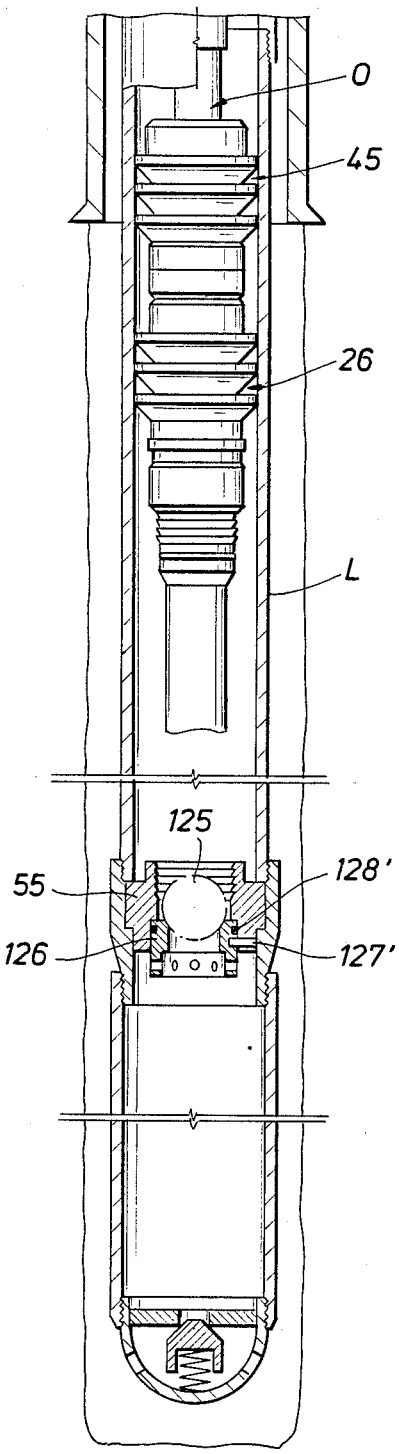
FIG. 19 is a sectional view partly in elevation and is a continuation of the lower end of FIG. 18 and illustrates the catcher means in the liner as well as means to restrict the flow for actuation of the hanger means hydraulically along with bearing means to accommodate rotation of the liner.

It can be appreciated that before actuating the hanger means H hydraulically as described, suitable means to force fluid from the operating string to chamber 120 is employed. As shown in FIG. 19, a ball 125 can be pumped down the operating string to seat on the releasable seat 126 which is releasably secured to the lower end of the catcher means 55 by the shear pin 127'. A suitable seal 128' is provided between the seat 126 and the catcher means 55 and when the ball 125 is seated on the seat 126, fluid pressure may be increased inside the operating string O and the liner L to move through port 122 into chamber 120 and actuate the second sleeve means as above described so that it moves longitudinally relative to sleeve S' and engage slip segments **18*a*, 19*a* simultaneously on segments 16*a*, 17*a*** and thereby suspend the liner L on the casing C.

After the liner is hung, an increase in pressure in the operating string may be employed to shear pin 127' so seat 126 and the ball will move into liner L beneath the catcher. The seat is constructed so as not to interfere with flow of cement through the liner L and out one-way valve 40 as previously described.

The sleeve means S' is supported on the projection or ring 116 at its lower end 115. The guide means G engage the strips 20 which are in turn secured to the second sleeve S". The second sleeve S" is in turn supported in the chamber 120 formed in the liner L. To prevent premature actuation of the hanger means H the second sleeve means S" is secured to liner L in chamber 120 by shear pin 129 which shears upon a predetermined pressure from the operating string through port 122 in the liner L to the chamber 120 to shear for relative longitudinal movement between the sleeve means S' and S" for simultaneously setting the hangers with the casing C as previously described. The annular chamber 120, seal arrangement 121 and shear means 129 thus form releasable means for releasably securing said second sleeve means S" to the liner.

FIG. 20 illustrates a hanger arrangement where the hanger means H may be mechanically set. If the mechanical set arrangement is employed, then the hydraulic form of FIG. 17 is eliminated and the structure shown in FIG. 20 would be substituted therefor. While the bearing means B is not shown in FIG. 20, it would assume the same relative position in FIG. 20 as is shown in FIG. 17. It can be appreciated that either the hydraulic set hanger arrangement of FIG. 18 may be employed between the apparatus shown in FIGS. 17 and 19, or a mechancal arrangement as shown in FIG. 20 may be used between the apparatus shown in FIGS. 17 and 19. FIG. 19 is an elevational view showing the upper and lower wiper means forming part of the cementing apparatus shown in detail in FIGS. 1–16 on the operating string. The cementing apparatus illustrated generally in FIGS. 1–16 may be used with the apparatus of FIGS. 17, 18 and 19, or that shown in FIGS. 17, 19 and 20 to accomplish the overall results of the methods of the present invention.

The sleeve means S' in FIG. 20 is rotatably supported on liner L for rotation relative thereto by bearing means similar to that shown in FIG. 18. The sleeve S' is supported at its lower end 115 by an annular ring 116 as described with regard to FIG. 18. The mechanical form also includes longitudinally spaced rows **90*a*, 91*a*, of conical segments 16*a*, 17*a*, both of which are mounted on the first sleeve means S'. Although two rows are shown, additional rows of segments may be employed if desired as well as a similar number of multiple rows of slip segments. The longitudinally spaced rows 18 and 19 of slip segments 18*a*, 19*a* are similar to those previously described. The strips 20 and 19*b* are secured, respectively, at one end to the slip segments 18*a*, 19*a* in rows 18, 19 of slip segments, and at their other end to sleeve means S" as shown in the drawings. The sleeve means S" is spaced longitudinally relative to sleeve means S'. The second sleeve means S" includes an extension 127 on which are mounted the circumferentially, longitudinally extending bow spring means 128. The second sleeve means S" is rotatably supported relative to the extension 127 by means of the overhanging shoulder 129 resting on the ring 130 supported on the ledge 131 of second sleeve S". When rotation is imparted to the operating string O before the release R is actuated, rotation of the liner hanger arrangements H is restrained by the bow springs 128 so that 127 tends to remain stationary while the liner rotates to thereby disengage pin 132 from the J-slot arrangement 133 adjacent the lower end of extension 127 forming part of second sleeve means S". The J-slot 133 and pin 132 form a releasable connection between the second sleeve S" and liner L in the FIG. 20 form. The J-slots 133 may be configured to release from pin 132 by right-hand or left-hand rotation of the operating strings. Also, the circumferentially spaced how springs 128 restrain longitudinal movement between the liner hanger arrangements H and the operating string O and liner L relative to 127 so that subsequent lowering of the operating string O and liner L relative to 127 after disconnection therebetween effects relative longitudinal movement between the second sleeve means S" and sleeve means S' to urge the row 18 of slip segments 18*a* and row 19 of slip segments 19*a* on to their respectively concically shaped segment rows 90*a* and 91*a'*** for securing the liner to the casing C.

The bore of the nut N of release means R is non-circular as is the adjacent portion of the mandrel M so that rotation of the operating string backs the nut N out of the threads on the outer member Q. The threads in nut N may be right-hand or left-hand, but ordinarily left-hand threads may be used so that when the operating string O is rotated to the right, the nut N will back out of its connection with the outer member Q. As noted previously, it may be desirable in some instances to rotate and/or reciprocate the liner L in the well bore to condition the well bore before the cementing operation, previously described, is begun. Also it may be desirable to rotate the liner L during cementing operations. The shoulder means 140 on the nut N engages abutting shoulder means 141 on the inner member I to enable the liner to be reciprocated in the well bore by raising and lowering the operating string O when it is assembled as shown in FIG. 17 and before the liner is hung on the casing C.

Where it is desired to rotate the liner L before supporting it on the casing C, longitudinal, circumferentially spaced slot means 145 within the outer member Q are engaged as shown in FIG. 17 with spring biased longitudinal, circumferentially spaced key means 146 positioned in slots **146*a*** on the inner member I whereby the liner may be rotated by rotating the operating string.

In normal cementing operations, the rotating string is manipulated to disengage the nut N before cementing operations are started so that the operating string connected with inner member I may be retrieved from outer member O and the liner L in the well bore in the event of some malfunction during the cementing operation. This avoids cementing the entire operating string O in the well bore. This is accomplished by longitudinally moving the operating string O to disengage keys 146 from slots 147 and then rotating the operating string O after the liner L has been hung on the casing C to disengage the nut N from between the operating string and outer member Q as above described. An arrangement is provided for rotating the liner in the well bore during cementing operations or after cementing operations have been completed by the plug and wiper means of the present invention.

The operating string O has been previously disengaged from outer member Q as above described and the outer member Q is now supported on the casing C along with liner L so that the operating string O may be lowered relative to outer member Q. When operating string O is lowered keys 146 disengage from slots 145 and the lowering of the operating string O is continued until the additional means referred to generally at 148 on the operating string O and outer member Q are interconnected so that rotation may be imparted to the liner. The additional means 148 in the FIG. 17 form is shown as consisting of longitudinally extending, circumferentially spaced rigid projections 149 to provide longitudinally extending recesses therebetween so that the projections and recesses may be interfitted with the circumferentially spaced projectins 150 adjacent the upper end of the outer member Q for imparting rotation to the outer member Q and to the liner L supported by means of the bearing B.

Another form of the additional means 148 may be employed which would merely consist of additional slot means in the outer member Q longitudinally spaced downwardly from and similar to the slot means 145 so that upon further lowering of the operating string, after keys 146 have disengaged from the upper slots 145, keys 146 on the operating string as shown in FIG. 17 thereon could be engaged in the lower, slot means (not shown) spaced from slot means 145 to effect rotation of the liner. It can be appreciated where the additional means is in the form of a second key or slot arrangement on the outer member longitudinally spaced from the first key 146 and slot means 145 shown in FIG. 17, the rigid projection arrangement 149 and splines 150 on the outer member would be eliminated. When the operating string has been lowered to disengage slots 145 and keys 146, further lowering thereof engages the spring loaded, circumferentially spaced keys (not shown) in the second circumferentially slots (not shown) so that rotation may then be imparted to the operating string.

From the foregoing description it can be seen that the present invention provides an arrangement to release the first or lower wiper means from the operating string in a manner to inhibit premature release of the second or upper wiper means. Also, the present invention contemplates an arrangement which enables the liner to be positioned in the well bore by either hydrualic or mechanically actuated hanger means as well as reciprocating and rotating the liner selectively as desired.

While the location of the portion **46*f* of the second wiper means 45 that extends into the bore 21 of the operating string is shown as being substantially adjacent the lower end of the second wiper means 45, it can be appreciated that it may be located at a higher elevation in the bore 21**.

While only one shear pin 81 is shown in the FIGS. 6–15 embodiment and only one shear pin is shown at **81*c* and 81*d* shown in the FIG. 16** embodiment, other circumferentially spaced shear pins are normally employed.

In the FIGS. 6–15 embodiment, when the same size pin 81 is employed at the same circumferential and longitudinal positions, both the lower wiper means 26 and upper wiper means 45 will release, or the pins 81 will shear, at the same load but at a different pressure in the operating string due to the effective seal area responsive to pressure on the engaged first plug and wiper means and engaged second plug and wiper means, respectively.

Thus, if it is desired to release both wiper means 26 and 45 at the same pressure, then additional shear pins which extend only between the wiper means 26 and operating string O are required. Such additional shear pins are circumferentially spaced relative to, and in the same transverse plane, relative to the longitudinal axis of the operating string, as the pins 81 which extend through both wiper means 26 and 45 and the operating string.

If it is desired to release the lower wiper means 26 and upper wiper means 45 at different loads, then the shear pins which support the lower and upper wiper means 26 and 45, respectively, may be spaced longitudinally as represented in FIG. 16.

In FIG. 16, the diameter of shear pin **81*c* within recess 28*e* is shown as larger than the diameter of shear pin 81*d*** within the recess in the operating string, so that the pins shear at different loads.

Where the liner is to be set on the well bore bottom, no hanger will be employed.

The present invention has been described in detail in connection with its use in well bore; however, it may be employed in any situation where it is desired to isolate a fluid in a tubular member or the like, even with varying internal diameters in the tubular member on adjacent tubular members.

The foregoing disclosure and description of the invention are illustrative and explanatory thereof, and various changes in size, shape and materials as well as in the details of the illustrated construction may be made without departing from the spirit of the invention.

What is claimed is:

1. Apparatus for cementing a liner in a well bore casing wherein cement enters the liner through an operating string with a bore therethrough and flows through the liner to the cementing region, comprising:

lower and upper spaced plug means for wiping the operating string bore ahead of and behind, respectively, the cement;

lower and upper spaced wiper means for wiping the liner ahead and behind, respectively, the cement upon engagement, respectively, with said lower and upper spaced plug means for movement through the liner; and means for releasably securing said lower wiper means to the operating string which extends through the longitudinal bore of said upper wiper means to terminate, respectively, adjacent the lower and upper ends of said upper and lower wiper means and in overlapping relation with said lower wiper means for releasably securing with said lower wiper means below the smallest internal diameter of said upper wiper means.

2. The apparatus of claim 1 wherein said upper and lower wiper means are secured to the operating string in substantially the same circumferential position and at substantially the same transverse position in relation to the longitudinal axis of the operating string and wherein one of said wiper means is further secured to the operating string at additional circumferentially spaced positions.

3. The apparatus of claim 1 wherein said upper and lower wiper means are secured to the operating string at longitudinally spaced positions in relation to the longitudinal axis of the operating string.

4. Apparatus for cementing a liner in a well bore casing wherein cement enters the liner through an operating string and flows through the liner to the cementing region, comprising:

lower and upper spaced plug means for wiping the operating string ahead of and behind, respectively, the cement;

lower and upper spaced wiper means for wiping the liner ahead of and behind, respectively, the cement upon engagement, respectively, with said lower and upper spaced plug means for movement through the liner;

said upper wiper means having circumferentially spaced openings through which the operating string extends longitudinally; and means for releasably securing said upper and lower wiper means to the operating string.

5. The apparatus of claim 4 wherein said lower and upper wiper means are secured to the operating string in substantially the same circumferential position and at substantially the same transverse position with respect to the operating string.

6. The apparatus of claim 4 wherein said lower and upper wiper means are secured to the operating string in substantially the same circumferential position and at substantially the same transverse position with respect to the operating string, and wherein said lower wiper means is further secured to the operating string at additional circumferentially spaced positions and at substantially the same transverse positions with respect to the operating string at which said upper wiper means is secured to the operating string.

7. The apparatus of claim 4 wherein said upper spaced wiper means is secured to the operating string in longitudinal spaced relation to the position at which said lower wiper means is secured thereto.

8. In a wiper for use in cementing operations in a well bore, said wiper comprising:

an annular body having a longitudinal bore therethrough that has two diameters one of which diameters is smaller than the other diameter;

circumferentially spaced segments extending longitudinally on said body and overlying the smaller diameter, bore;

said spaced segments defining longitudinal, external recesses in said body between said spaced segments and overlying the smaller diameter bore; and said longitudinal recesses having openings therein communicating with the larger diameter bore of said body.

9. The apparatus of claim 8 wherein said segments have cooperating surface means to engage said body with the wiper.

10. The apparatus of claim 9 wherein said cooperating surface means are external threads on said segments.

11. Apparatus for cementing a liner in a well bore casing wherein cement enters the liner from an operating string with a bore therethrough and flows to the cementing region, comprising:

lower and upper spaced plug means for wiping the operating string bore ahead of and behind, respectively, the cement;

lower and upper spaced wiper means each with a longitudinal bore therein for receiving, respectively, said lower and upper spaced plug means for wiping the liner ahead of and behind, respectively, the cement upon engagement, respectively, with said lower and upper plug means for movement through the liner;

said upper wiper means surrounding the lower end of the operating string and extending through and into the bore of the operating string; and means for releasably securing said lower wiper means within the upper wiper means, said means also securing said upper and lower wiper means within the bore of the operating string below the smallest internal diameter of the bore of said upper wiper means.

12. The apparatus of claim 11 wherein said lower and upper wiper means are secured to the operating string in substantially the same circumferential position and at substantially the same transverse position with respect to the operating string.

13. The apparatus of claim 11 wherein said lower and upper wiper means are secured to the operating string in substantially the same circumferential position and at substantially the same transverse position with respect to the operating string, and wherein said lower wiper means is further secured to the operating string at additional circumferentially spaced positions and at substantially the same transverse positions with respect to the operating string at which said upper wiper means is secured to relation to the longitudinal axis of the operating string.

14. Apparatus for cementing a liner in a well bore casing wherein cement enters the liner from an operating string with a bore therethrough and flows to the cementing region, comprising:

lower and upper spaced plug means for wiping the operating string bore ahead of and behind, respectively, the cement;

lower and upper spaced wiper means for wiping the liner ahead of and behind, respectively, the cement upon engagement, respectively with said lower and upper plug means for movement through the liner;

said upper wiper means having circumferentially spaced openings to receive the operating string longitudinally therethrough; and means for releasably securing said lower wiper means to the operating string which extends through the circumferential openings into said upper wiper means.

15. Apparatus for cementing a liner in a well bore casing wherein cement enters the liner from an operating string with a bore therethrough and flows to the cementing region, comprising:

lower and upper spaced plug means for wiping the operating string bore ahead of and behind, respectively, the cement;

lower and upper spaced wiper means for wiping the liner ahead of and behind, respectively, the cement upon engagement, respectively, with said lower and upper plug means for movement through the liner;

said upper wiper means having circumferentially spaced openings to receive the operating string longitudinally therethrough; and means for releasably securing each said lower and upper wiper means to the operating string below the smallest internal diameter of said upper wiper means.

16. Apparatus for cementing a liner in a well bore casing wherein cement enters the liner from an operating string and flows to the cementing region, comprising:

lower and upper spaced plug means for wiping the operating string ahead of and behind, respectively, the cement;

lower and upper wiper means for wiping the liner ahead of and behind, respectively, the cement upon engagement, respectively, with said lower and upper plug means for movement through the liner;

said upper wiper means having a portion extending through the operating string and into the bore thereof to receive said upper plug means for movement of said upper wiper and plug means together through the liner; and means for releasably securing said lower and upper wiper means to the operating string adjacent the lower end of said upper wiper means.

17. The apparatus of claim 16 wherein said lower and upper wiper means are releasably secured to the operating string in substantially the same circumferential position and at substantially the same transverse position with respect to the operating string.

18. The apparatus of claim 16 wherein said lower and upper wiper means are secured to the operating string in substantially the same circumferential position and at substantially the same transverse position with respect to the operating string, and wherein said lower wiper means is further secured to the operating string at additional circumferentially spaced positions and at substantially the same transverse positions with respect to the operating string at which said upper wiper means is secured to the operating string.

19. Apparatus for cementing a liner in a well bore casing wherein cement enters the liner from an operating string and flows to the cementing region, comprising:

lower and upper spaced plug means for wiping the operating string ahead of and behind, respectively, the cement;

lower and upper wiper means for wiping the liner ahead of and behind, respectively, the cement upon engagement, respectively, with said lower and upper plug means for movement through the liner;

said upper wiper means having a portion extending through the operating string and into the bore thereof to receive said upper plug means for movement of said upper wiper and plug means together through the liner;

means for releasably securing said lower wiper means to the operating string below said upper wiper means portion; and means for releasably securing said upper wiper means to the operating string at a position longitudinally spaced from the position at which the lower wiper means is releasably secured to the operating string.

20. Apparatus for cementing a liner in a well bore casing wherein the liner is releasably supported on an operating string having a bore for supplying cement through the liner to the well bore cementing region, comprising:

first and second spaced plug means for wiping the operating string bore ahead of and behind, respectively, the cement;

first and second wiper means, each having a longitudinal bore therein for receiving, respectively, said first and second spaced plug means therein for wiping the liner ahead of and behind, respectively, the cement upon engagement, respectively, with said first and second spaced plug means for movement through the liner;

said second wiper means having circumferentially spaced openings through which the operating string extends longitudinally; and means for releasably securing said first wiper means adjacent the operating string which extends through the circumferential openings and adjacent the lower end of said second wiper means so that the longitudinal bore of said first wiper means originates and extends away from adjacent said lower end of the operating string and said second wiper means.

21. Apparatus for cementing a liner in a well bore casing wherein the liner is releasably supported on an operating string having a bore for supplying cement through the liner to the well bore cementing region, comprising:

lower and upper spaced plug means for wiping the operating string bore ahead of and behind, respectively, the cement;

lower and upper wiper means, each having a longitudinal bore therein for receiving, respectively, said lower and upper spaced plug means therein for wiping the liner ahead of and behind, respectively, the cement upon engagement, respectively, with said lower and upper spaced plug means for movement through the liner;

said second wiper means having circumferentially spaced openings through which the operating string extends longitudinally; and means for releasably securing said lower wiper means to the operating string which extends through the circumferential openings so that the longitudinal bore of said lower wiper means originates and extends away from adjacent said lower end portion of said upper wiper means.

22. The apparatus of claim 21 wherein said lower and upper wiper means are secured to the operating string in substantially the same circumferential position and at substantially the same transverse position with respect to the operating string.

23. The apparatus of claim 21 wherein said lower and upper wiper means are secured to the operating string in substantially the same circumferential position and at substantially the same transverse position with respect to the operating string, and wherein said lower wiper means is further secured to the operating string at additional circumferentially spaced positions and at substantially the same transverse positions with respect to the operating string at which said upper wiper means is secured to the operating string.

24. The apparatus of claim 21 wherein said upper wiper means is secured to the operating string at a position spaced longitudinally from the position in the operating string at which said lower wiper means is releasably secured.

25. Apparatus for cementing a liner in a well bore casing wherein cement enters the liner from an operating string and flows to the cementing region, comprising:

lower and upper spaced plug means for wiping the operating string ahead of and behind, respectively, the cement;

lower and upper spaced wiper means for wiping the liner ahead of and behind, respectively, the cement upon engagement, respectively, with said lower and upper plug means for movement through the liner;

said upper wiper means having circumferentially spaced openings through which the operating string extends longitudinally; and means for releasably securing said lower wiper means adjacent the termination of the operating string which extends through the circumferential openings below the smallest internal diameter of said upper wiper means.

26. Apparatus for cementing a liner in a well bore casing wherein the cement enters the liner through the bore of an operating string and flows through the liner to the cementing region, comprising:

first and second spaced plug means for wiping the operating string bore ahead of and behind, respectively, the cement;

first and second wiper means for wiping the liner ahead of and behind, respectively, the cement;

said first and second wiper means having means for receiving said first plug means for movement of said first wiper and plug means together;

said second wiper means having a portion extending through the operating string and into the bore thereof to receive said second plug means for movement of said second wiper and plug means together;

means for releasably securing the first wiper means to the operating string below said second wiper means portion;

latch means for latching said first plug means with said first wiper means against premature separation as said engaged first plug and wiper means move through the liner;

means for catching said first wiper means in the liner;

means for releasing said first plug means for movement longitudinally relative to said first wiper means when said catching means catches said first wiper means for passage of the cement from between said first wiper means and second wiper and plug means and out the liner to the cementing region;

one-way valve means supported by the liner for preventing backflow of the cement into the liner; and means for securing said first and second wiper and plug means together as a unit in said catcher means after displacement of the cement to the cementing region.

27. Apparatus for cementing a liner in a well bore casing wherein the cement enters the liner through the bore of an operating string and flows through the liner to the cementing region, comprising:

first and second spaced plug means for wiping the operating string bore ahead of and behind, respectively, the cement;

first and second wiper means for wiping the liner ahead of and behind, respectively, the cement;

said first wiper means having means for receiving said first plug means for movement of said first wiper and plug means together;

said second wiper means having means for receiving said second plug means for movement of said second wiper and plug means together;

said second wiper means having circumferentially spaced openings through which the operating string extends longitudinally;

means for releasably securing said first and second wiper means adjacent the operating string which extends through the circumferential openings in said second wiper means and terminates in overlapping relation with said first wiper means;

latch means for latching said first plug means with said first wiper means;

means for locking said latch means against premature separation as said engaged first plug and wiper means move through the liner;

means for catching said first wiper means in the liner;

means for unlocking said first plug means from said first wiper means for movement of said first plug means longitudinally relative to said first plug means when said catching means catches said first wiper means whereby the cement from between said first wiper means and second wiper and plug means may pass out the liner to the cementing region;

one-way valve means supported by the liner for preventing backflow of the cement into the liner; and means for securing said first and second wiper and plug means together as a unit in said catcher means after displacement of the cement of the cementing region.

28. Apparatus for cementing a liner in a well bore casing wherein the cement enters the liner through the bore of an operating string and flows through the liner to the cementing region, comprising:

first and second spaced plug means for wiping the operating string bore ahead of and behind, respectively, the cement;

first and second wiper means for wiping the liner ahead of and behind, respectively, the cement;

said first wiper means having means for receiving said first plug means for movement of said first wiper and plug means together;

said second wiper means having means for receiving said second plug means for movement of said second wiper and plug means together;

means for releasably securing said first wiper means within said second wiper means and to the operating string below the smallest internal diameter of said second wiper means;

latch means for latching said first plug means with said first wiper means;

means for locking said latch means against premature separation as said engaged first plug and wiper means move through the liner;

means for catching said first wiper means in the liner;

means for unlocking said first plug means from said first wiper means for movement of said first plug means longitudinally relative to said first wiper means when said catching means catches said first wiper means whereby the cement from between said first wiper means and second wiper and plug means may pass out the liner to the cementing region;

one-way valve means supported by the liner for preventing backflow of the cement into the liner; and means for securing said first and second wiper and plug means together as a unit in said catcher means after displacement of the cement to the cementing region.

29. Apparatus for cementing a liner in a well bore casing wherein the cement enters the liner through the bore of an operating string and flows through the liner to the cementing region, comprising:

first and second spaced plug means for wiping the operating string bore ahead of and behind, respectively, the cement;

first and second wiper means for wiping the liner ahead of and behind, respectively, the cement;

said first wiper means having means for receiving said first plug means for movement of said first wiper and plug means together;

said second wiper means having means for receiving said second plug means for movement of said second wiper and plug means together;

means for releasably securing said first wiper means to the operating string which extends through said second wiper means to terminate adjacent the lower and upper ends of said second and first wiper means, respectively, so that the longitudinal bore of said first wiper means originates and extends away from adjacent the lower end of the operating string and adjacent said lower end of said second wiper means;

latch means for latching said first plug means with said first wiper means against premature separation as said engaged first plug and wiper means move through the liner;

means for catching said first wiper means in the liner;

means for unlocking said first plug means from said first wiper means for movement of said first plug means longitudinally relative to said first wiper means when said catching means catches said first wiper means whereby the cement from between said first wiper means and second wiper and plug means may pass out the liner to the cementing region;

one-way valve means supported by the liner for preventing backflow of the cement into the liner; and means for securing said first and second wiper and plug means together as a unit in said catcher means after displacement of the cement to the cementing region.

30. Apparatus for cementing a liner in a well bore casing wherein the cement enters the liner through the bore of an operating string and flows through the liner to the cementing region, comprising:

first and second spaced plug means for wiping the operating string bore ahead of and behind, respectively, the cement;

first and second wiper means for wiping the liner ahead of and behind, respectively, the cement;

said second wiper means having a portion extending through the operating string and into the bore thereof to receive said second plug means for movement of said second wiper and plug means together;

said second wiper means having circumferentially spaced openings through which the operating string extends longitudinally;

latch means for latching said first plug means with said first wiper means against premature separation as said engaged first plug and wiper means move through the liner;

means for catching said first wiper means in the liner;

means for releasing said first plug means for movement longitudinally relative to said first wiper means when said catching means catches said first wiper means for passage of the cement from between said first wiper means and second wiper and plug means and out the liner to the cementing region;

one-way valve means supported by the liner for preventing backflow of the cement into the liner; and means for securing said first and second wiper and plug means together as a unit in said catcher means after displacement of the cement to the cementing region.

31. Apparatus for cementing a liner in a well bore casing wherein the cement enters the liner through the bore of an operating string and flows through the liner to the cementing region, comprising:

seal means for sealing between the liner and the operating string;

means for positioning the liner in the well bore;

first and second spaced plug means for wiping the operating string bore ahead of and behind, respectively, the cement;

first and second wiper means for wiping the liner ahead of and behind, respectively, the cement upon engagement, respectively, with said first and second spaced plug means for movement through the liner;

said upper wiper means having circumferentially spaced openings to receive the operating string longitudinally therethrough; and means for releasably securing said first and second wiper means to the operating string which extends through the circumferentially spaced openings in said upper wiper means to terminate adjacent the lower and upper ends of said second and first wiper means, respectively, and in overlapping relation with said first wiper means for securing therewith.

32. The apparatus of claim 31 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes hanger means on the liner for securing the liner to the casing in the well bore and means for securing the liner with the hanger means thereon on the operating string whereby the liner and operating string may be disconnected from each other upon relative rotation therebetween, said hanger means including:

at least one cone shaped enlargement on the liner;

at least one sleeve means slidable on the liner;

slip means on said slidable sleeve means;

cooperating latch means on the liner and said slidable sleeve means for releasably securing them together;

said latch means including:

a J-shaped slot in said slidable sleeve means;

lug means on the liner and engaged in said slot; and bow spring means on said slidable sleeve means engageable with the well bore casing whereby as the liner and sleeve means move through the well bore casing in one direction said lug means is positioned in said slot to restrain relative longitudinal and rotational movement between the liner and said slidable sleeve means; and said latch means, upon longitudinal movement of the liner in the other direction in the well bore casing and then rotating it while said slidable sleeve means is restrained by said bow spring means engaging the well bore casing, releasing to accommodate longitudinal movement of said slip means relative to the liner to engage said slip means and cone shaped enlargement for urging said slip means radially into gripping engagement with the well bore casing.

33. The apparatus of claim 31 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

hanger means on the liner for securing the liner to the casing in the well bore and means for securing the liner with the hanger means thereon on the operating string whereby the liner and operating string may be disconnected from each other upon relative rotation therebetween, said hanger means including:

at least one cone shaped enlargement on the liner;

at least one sleeve means slidable on the liner;

slip means on said slidable sleeve means;

the liner having at least one annular chamber thereon in which one end of one of said slidable sleeve means is telescopically received;

seal means sealing between the annular chamber and said slidable sleeve means responsive to fluid pressure through port means in the liner for moving said slidable sleeve means longitudinally for engagement of said slip means with said cone shaped enlargement for urging said slip means radially into gripping engagement with the well bore casing; and means for restricting fluid flow through the operating string for supplying fluid pressure from the operating string through the port means therein to the annular chamber.

34. The apparatus of claim 31 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

means to rotate and reciprocate the liner before supporting it on the well bore casing and for rotating the liner after it is supported on the well bore casing comprising:

inner and outer telescopically arranged members;

said outer member having the liner secured thereto;

($1_x$) hanger means supported on the liner for hanging the liner on the well bore casing; and ($2_x$) bearing means on said outer member to accommodate rotation of said outer member and the liner relative to the casing and said hanger means;

said inner member having a non-circular mandrel connected with the operating string;

means supporting said outer member and the liner on said inner member, said means including:

($1_x$) thread means on said outer member; and ($2_x$) disengaging nut means threadedly secured on said thread means telescopically receiving said mandrel whereby longitudinal movement and then rotation of the operating string disconnects said disengaging nut means from said thread means and releases said outer member from said inner member and the operating string;

means on said inner and outer members to reciprocate and rotate the liner by manipulating the operating string before the liner is supported on the casing;

said means to reciprocate before supporting the liner on the casing including shoulder means on said disengaging nut means and abutting shoulder means on said inner member whereby the liner may be reciprocated in the well bore by raising and lowering the operating string;

said means to rotate before supporting the liner on the casing including first longitudinal slot means in said outer member and spring biased longitudinal key means on said inner member engaged in said slot means whereby the liner may be rotated by rotating the operating string; and additional means on said inner and outer members releasably engageable after said inner and outer members are released from each other to rotate said outer member and liner relative to said hanger means and the casing upon rotating the operating string, said additional means including second longitudinal slot means in the outer member spaced longitudinally from said first slot means and engageable with said spring biased longitudinal key means on said inner member when the operating string is manipulated to align said key means on said inner member with said second slot means.

35. The apparatus of claim 31 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

means to rotate and reciprocate the liner before supporting it on the well bore casing and for rotating the liner after it is supported on the well bore casing comprising:

inner and outer telescopically arranged members;

said outer member having the liner secured thereto;

($1_x$) hanger means supported on the liner for hanging the liner on the well bore casing; and ($2_x$) bearing means on said outer member to accommodate rotation of said outer member and the liner relative to the casing and said hanger means;

said inner member having a non-circular mandrel connected with the operating string;

means supporting said outer member and the liner on said inner member, said means including:

($1_x$) thread means on said outer member; and ($2_x$) disengaging nut means threadedly secured on said thread means telescopically receiving said mandrel whereby longitudinal movement and then rotation of the operating string disconnects said disengaging nut means from said thread means and releases said outer member from said inner member and the operating string;

means on said inner and outer members to reciprocate and rotate the liner by manipulating the operating string before the liner is supported on the casing;

said means to reciprocate before supporting the liner on the casing including shoulder means on said disengaging nut means and abutting shoulder means on said inner member whereby the liner may be reciprocated in the well bore by raising and lowering the operating string;

said means to rotate before supporting the liner on the casing including first longitudinal slot means in said outer member and spring biased longitudinal key means on said inner member engaged in said slot means whereby the liner may be rotated by rotating the operating string; and additional means on said inner and outer members releasably engageable after said inner and outer members are released from each other to rotate said outer member and liner relative to said hanger means and the casing upon rotating the operating string, said additional means including inter-fitting groove and circumferentially spaced rigid projection means formed adjacent the upper end of said outer member and the lower end of the operating string, respectively.

36. The apparatus of claim 31 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

hanger means for hanging the liner on the well bore casing;

means for releasably connecting the operating string with the liner and said liner hanger means;

said hanger means including:

first sleeve means mounted on the liner for rotation of the liner relative thereto;

at least two longitudinally spaced annular rows of conically shaped, circumferentially spaced segments on said first sleeve means with the segments in each row being off-set circumferentially; second sleeve means slidably mounted on the liner for relative rotation and longitudinal movement between said second sleeve means and the liner, said second sleeve means being spaced from said first sleeve means;

at least two rows of hanger slips supported by said second sleeve means with said hanger slips in each row being off-set circumferentially and with said hanger slips in each row being aligned with the segments in a row of segments;

means secured to said hanger slips adjacent one end and to said second sleeve means at the other end;

release means for releasably securing said second sleeve means to the liner whereby said second sleeve means may be released for relative longitudinal movement between it and said first sleeve means to simultaneously engage all said rows of hanger slips on said respective rows of conical segments to hang the liner in the well bore casing by said hanger means;

said release means including:

a J-shaped slot in said second sleeve means;

lug means on the liner and engaged in said slot;

bow spring means on said second sleeve means engageable with the well bore casing whereby as the liner and said first and second sleeve means move through the well bore casing in one direction said lug means is positioned in said slot to restrain relative longitudinal movement between the liner and said second sleeve means; and said latch means, upon longitudinal movement of the liner in the other direction in the well bore casing and then rotating it while said second sleeve means is restrained by said bow spring means engaging the well bore casing, releasing to accommodate longitudinal movement of said second sleeve means relative to the liner to engage said hanger slips and conical segments for urging said hanger slips radially into gripping engagement with the well bore casing;

bearing means on the liner to accommodate rotation of the liner; and cooperating means on the operating string and liner to rotate and reciprocate the liner before hanging it and for rotating the liner after it is hung on the well bore casing.

37. The apparatus of claim 31 wherein said seal means includes:

body means for fitting between the operating string and the liner;

seal means on said body for engaging the inner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

hanger means for hanging the liner on the well bore casing;

means for releasably connecting the operating string with the liner and said liner hanger means;

said hanger means including:

first sleeve means mounted on the liner for rotation of the liner relative thereto;

at least two longitudinally spaced annular rows of conically shaped, circumferentially spaced segments on said first sleeve means with the segments in each row being off-set circumferentially;

second sleeve means slidably mounted on the liner for relative rotation and longitudinal movement between said second sleeve means and the liner, said second sleeve have means being spaced from said first sleeve means;

at least two rows of hanger slips supported by said second sleeve means with said hanger slips in each row being off-set circumferentially and with said hanger slips in each row being aligned with the segments in a row of segments;

means secured to said hanger slips adjacent one end and to said second sleeve means at the other end;

release means for releasably securing said second sleeve means to the liner whereby said second sleeve means may be released for relative longitudinal movement between it and said first sleeve means to simultaneously engage all said rows of hanger slips on said respective rows of conical segments to hang the liner in the well bore casing by said hanger means;

said release means including:

an annular longitudinally extending chamber in the liner in which one end of said second sleeve means is telescopically received; and seal means sealing between the annular chamber and said second sleeve means responsive to fluid pressure through a port in the liner for moving said second sleeve means longitudinally for engagement of said hanger slips with said conical segments for urging said hanger slips radially into gripping engagement with the well bore casing;

bearing means on the liner to accommodate rotation of the liner; and cooperating means on the operating string and liner to rotate and reciprocate the liner before hanging it and for rotating the liner after it is hung on the well bore casing.

38. Apparatus for cementing a liner in a well bore casing wherein the liner is releasably supported on an operating string having a bore for supplying cement through the liner to the well bore cementing region, comprising:

seal means for sealing between the liner and the operating string;

means for positioning the liner in the well bore;

first and second spaced plug means for wiping the operating string bore ahead of and behind, respectively, the cement;

first and second wiper means for wiping the liner ahead of and behind, respectively, the cement upon engagement, respectively, with said upper and lower spaced plug means for movement through the liner;

said second wiper means having a portion extending through the operating string and into the bore thereof to receive said second plug means for movement of said second wiper and plug means together through the liner; and means for releasably securing said first wiper means to the operating string adjacent the lower end of said second wiper means portion.

39. The apparatus of claim 38 including means for releasably securing said second wiper means to the operating string.

40. The apparatus of claim 38 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes hanger means on the liner for securing the liner to the casing in the well bore and means for securing the liner with the hanger means thereon on the operating string whereby the liner and operating string may be disconnected from each other upon relative rotation therebetween, said hanger means including:

at least one cone shaped enlargement on the liner;

at least one sleeve means slidable on the liner;

slip means on said sleeve means;

cooperating latch means on the liner and said sleeve means for releasably securing them together;

said latch means including:

a J-shaped slot in said sleeve means;

lug means on the liner and engaged in said slot; and bow spring means on said sleeve means engageable with the well bore casing whereby as the liner and sleeve means move through the well bore casing in one direction said lug means is positioned in said slot to restrain relative longitudinal and rotational movement between the liner and said sleeve means; and said latch means, upon longitudinal movement of the liner in the other direction in the well bore casing and then rotating it while said sleeve means is restrained by said bow spring means engaging the well bore casing, releasing to accommodate longitudinal movement of said slip means relative to the liner to engage said slip means and cone shaped enlargement for urging said slip means radially into gripping engagement with the well bore casing.

41. The apparatus of claim 38 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes hanger means on the liner for securing the liner to the casing in the well bore and means for securing the liner with the hanger means thereon on the operating string whereby the liner and operating string may be disconnected from each other upon relative rotation therebetween, said hanger means including:

at least one cone shaped enlargement on the liner;

at least one sleeve means slidable on the liner;

slip means on said slidable sleeve means;

releasable means for securing one of said sleeve means to the liner;

the liner having an annular chamber thereon in which one end of one of said slidable sleeve means is telescopically received;

seal means sealing between the annular chamber and said sleeve means responsive to fluid pressure through port means in the liner for moving said one of said sleeve means longitudinally for engagement of said slip means with said cone shaped enlargement for urging said slip means radially into gripping engagement with the well bore casing; and means for restricting fluid flow through the operating string for supplying fluid pressure from the operating string through the port means therein to the annular chamber.

42. The apparatus of claim 38 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

means to rotate and reciprocate the liner before supporting it on the well bore casing and for rotating the liner after it is supported on the well bore casing comprising:

inner and outer telescopically arranged members;

said outer member having the liner secured thereto;

(1) hanger means supported on the liner for hanging the liner on the well bore casing; and (2) bearing means on said outer member to accommodate rotation of said outer member and the liner relative to the casing and said hanger means;

said inner member having a non-circular mandrel connected with the operating string;

means supporting said outer member and the liner on said inner member, said means including:

(1) thread means on said outer member; and (2) disengaging nut means threadedly secured on said thread means telescopically receiving said mandrel whereby longitudinal movement and then rotation of the operating string disconnects said disengaging nut means from said thread means and releases said outer member from said inner member and the operating string;

means on said inner and outer members to reciprocate and rotate the liner by manipulating the operating string before the liner is supported on the casing;

said means to reciprocate before supporting the liner on the casing including shoulder means on said disengaging nut means and abutting shoulder means on said inner member whereby the liner may be reciprocated in the well bore by raising and lowering the operating string;

said means to rotate before supporting the liner on the casing including first longitudinal slot means in said outer member and spring biased longitudinal key means on said inner member engaged in said slot means whereby the liner may be rotated by rotating the operating string; and additional means on said inner and outer members releasably engageable after said inner and outer members are released from each other to rotate said outer member and liner relative to said hanger means and the casing upon rotating the operating string, said additional means including second longitudinal slot means in the outer member spaced longitudinally from said first slot means and engageable with said spring biased longitudinal key means on said inner member when the operating string is manipulated to align said key means on said inner member with said second slot means.

43. The apparatus of claim 38 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

means to rotate and reciprocate the liner before supporting it on the well bore casing and for rotating the liner after it is supported on the well bore casing comprising:

inner and outer telescopically arranged members;

said outer member having the liner secured thereto;

(1) hanger means supported on the liner for hanging the liner on the well bore casing; and (2) bearing means on said outer member to accommodate rotation of said outer member and the liner relative to the casing and said hanger means;

said inner member having a non-circular mandrel connected with the operating string;

means supporting said outer member and the liner on said inner member, said means including:

(1) thread means on said outer member; and (2) disengaging nut means threadedly secured on said thread means telescopically receiving said mandrel whereby longitudinal movement and then rotation of the operating string disconnects said disengaging nut means from said thread means and releases said outer member from said inner member and the operating string;

means on said inner and outer members to reciprocate and rotate the liner by manipulating the operating string before the liner is supported on the casing;

said means to reciprocate before supporting the liner on the casing including shoulder means on said disengaging nut means and abutting shoulder means on said inner member whereby the liner may be reciprocated in the well bore by raising and lowering the operating string;

said means to rotate before supporting the liner on the casing including first longitudinal slot means in said outer member and spring biased longitudinal key means on said inner member engaged in said slot means whereby the liner may be rotated by rotating the operating string; and additional means on said inner and outer members releasably engageable after said inner and outer members are released from each other to rotate said outer member and liner relative to said hanger means and the casing upon rotating the operating string, said additional means including inter-fitting groove and circumferentially spaced rigid projection means formed adjacent the upper end of said outer member and the lower end of the operating string, respectively.

44. The apparatus of claim 38 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

hanger means for hanging the liner on the well bore casing;

means for releasably connecting the operating string with the liner and said liner hanger means;

said hanger means including:

first sleeve means mounted on the liner for rotation of the liner relative thereto;

at least two longitudinally spaced annular rows of conically shaped, circumferentially spaced segments on said first sleeve means with the segments in each row being off-set circumferentially;

second sleeve means slidably mounted on the liner for relative rotation and longitudinal movement between said second sleeve means and the liner, said second sleeve means being spaced from said first sleeve means;

at least two rows of hanger slips supported by said second sleeve means with said hanger slips in each row being off-set circumferentially and with said hanger slips in each row being aligned with the segments in a row of segments;

means secured to said hanger slips adjacent one end and to said second sleeve means at the other end;

release means for releasably securing said second sleeve means to the liner whereby said second sleeve means may be released for relative longitudinal movement between it and said first sleeve means to simultaneously engage all said rows of hanger slips on said respective rows of conical segments to hang the liner in the well bore casing by said hanger means;

said release means including:

a J-shaped slot in said second sleeve means;

lug means on the liner and engaged in said slot;

bow spring means on said second sleeve means engageable with the well bore casing whereby as the liner and said first and second sleeve means move through the well bore casing in one direction said lug means is positioned in said slot to restrain relative longitudinal movement between the liner and said second sleeve means; and said latch means, upon longitudinal movement of the liner in the other direction in the well bore casing and then rotating it while said second sleeve means is restrained by said bow spring means engaging the well bore casing, releasing to accommodate longitudinal movement of said second sleeve means relative to the liner to engage said hanger slips and conical segments for urging said hanger slips radially into gripping engagement with the well bore casing;

bearing means on the liner to accommodate rotation of the liner; and cooperating means on the operating string and liner to rotate and reciprocate the liner before hanging it and for rotating the liner after it is hung on the well bore casing.

45. The apparatus of claim 38 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

hanger means for hanging the liner on the well bore casing;

means for releasably connecting the operating string with the liner and said liner hanger means;

said hanger means including:

first sleeve means mounted on the liner for rotation of the liner relative thereto;

at least two longitudinally spaced annular rows of conically shaped, circumferentially spaced segments on said first sleeve means with the segments in each row being off-set circumferentially;

second sleeve means slidably mounted on the liner for relative rotation and longitudinal movement between said second sleeve means and the liner, said second sleeve means being spaced from said first sleeve means;

at least two rows of hanger slips supported by said second sleeve means with said hanger slips in each row being off-set circumferentially and with said hanger slips in each row being aligned with the segments in a row of segments;

means secured to said hanger slips adjacent one end and to said second sleeve means at the other end;

release means for releasably securing said second sleeve means to the liner whereby said second sleeve means may be released for relative longitudinal movement between it and said first sleeve means to simultaneously engage all said rows of hanger slips on said respective rows of conical segments to hang the liner in the well bore casing by said hanger means;

said release means including:

an annular longitudinally extending chamber in the liner which one end of said second sleeve means is telescopically received; and seal means sealing between the annular chamber and said second sleeve means responsive to fluid pressure through a port in the liner for moving said second sleeve means longitudinally for engagement of said hanger slips with said conical segments for urging said hanger slips radially into gripping engagement with the well bore casing;

bearing means on the liner to accommodate rotation of the liner; and cooperating means on the operating string and liner to rotate and reciprocate the liner before hanging it and for rotating the liner after it is hung on the well bore casing.

46. Apparatus for cementing a liner in a well bore casing wherein the liner is releasably supported on an operating string having a bore for supplying cement through the liner to the well bore cementing region, comprising:

seal means for sealing between the liner and the operating string;

means for positioning the liner in the well bore;

first and second spaced plug means for wiping the operating string bore ahead of and behind, respectively, the cement;

first and second wiper means for wiping the liner ahead of and behind, respectively, the cement upon engagement, respectively, with said first and second spaced plug means for movement through the liner;

said second wiper means having means thereon extending through circumferentially spaced openings in the operating string and forming a smaller internal diameter in the operating string than the remainder of the bore the operating string whereby said first plug means seats on said smaller diameter so that said first wiper and plug means wipes ahead of the cement in the liner; and said second wiper means having circumferentially spaced openings through which the operating string extends longitudinally; and means for releasably securing said first wiper means to the operating string.

47. The apparatus of claim 46 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes hanger means on the liner for securing the liner to the casing in the well bore and means for securing the liner with the hanger means thereon on the operating string whereby the liner and operating string may be disconnected from each other upon relative rotation therebetween, said hanger means including:

at least one cone shaped enlargement on the liner;

at least one sleeve means slidable on the liner;

slip means on said sleeve means;

cooperating latch means on the liner and said sleeve means for releasably securing them together;

said latch means including:

a J-shaped slot in said sleeve means;

lug means on the liner and engaged in said slot; and bow spring means on said sleeve means engageable with the well bore casing whereby as the liner and sleeve means move through the well bore casing in one direction said lug means is positioned in said slot to restrain relative longitudinal and rotational movement between the liner and said sleeve means; and said latch means, upon longitudinal movement of the liner in the other direction in the well bore casing and then rotating it while said sleeve means is restrained by said bow spring means engaging the well bore casing, releasing to accommodate longitudinal movement of said slip means relative to the liner to engage said slip means and cone shaped enlargement for urging said slip means radially into gripping engagement with the well bore casing.

48. The apparatus of claim 46 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes hanger means on the liner for securing the liner to the casing in the well bore and means for securing the liner with the hanger means thereon on the operating string whereby the liner and operating string may be disconnected from each other upon relative rotation therebetween, said hanger means including:

at least one cone shaped enlargement on the liner;

at least one sleeve means slidable on the liner;

slip means on said slidable sleeve means;

releasable means for securing one of said sleeve means to the liner;

the liner having an annular chamber thereon in which one end of one of said slidable sleeve means is telescopically received;

seal means sealing between the annular chamber and said sleeve means responsive to fluid pressure through port means in the liner for moving said one of said sleeve means longitudinally for engagement of said slip means with said cone shaped enlargement for urging said slip means radially into gripping engagement with the well bore casing; and means for restricting fluid flow through the operating string for supplying fluid pressure from the operating string through the port means therein to the annular chamber.

49. The apparatus of claim 46 wherein said seal means includes: body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

means to rotate and reciprocate the liner before supporting it on the well bore casing and for rotating the liner after it is supported on the well bore casing comprising:

inner and outer telescopically arranged members;

said outer member having the liner secured thereto;

(1) hanger means supported on the liner for hanging the liner on the well bore casing; and (2) bearing means on said outer member to accommodate rotation of said outer member and the liner relative to the casing and said hanger means;

said inner member having a non-circular mandrel connected with the operating string;

means supporting said outer member and the liner on said inner member, said means including:

(1) thread means on said outer member; and (2) disengaging nut means threadedly secured on said thread means telescopically receiving said mandrel whereby longitudinal movement and then rotation of the operating string disconnects said disengaging nut means from said thread means and releases said outer member from said inner member and the operating string;

means on said inner and outer members to reciprocate and rotate the liner by manipulating the operating string before the liner is supported on the casing;

said means to reciprocate before supporting the liner on the casing including shoulder means on said disengaging nut means and abutting shoulder means on said inner member whereby the liner may be reciprocated in the well bore by raising and lowering the operating string;

said means to rotate before supporting the liner on the casing including first longitudinal slot means in said outer member and spring biased longitudinal key means on said inner member engaged in said slot means whereby the liner may be rotated by rotating the operating string; and additional means on said inner and outer members releasably engageable after said inner and outer members are released from each other to rotate said outer member and liner relative to said hanger means and the casing upon rotating the operating string, said additional means including second longitudinal slot means in the outer member spaced longitudinally from said first slot means and engageable with said spring biased longitudinal key means on said inner member when the operating string is manipulated to align said key means on said inner member with said second slot means.

50. The apparatus of claim 46 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

means to rotate and reciprocate the liner before supporting it on the well bore casing and for rotating the liner after it is supported on the well bore casing comprising:

inner and outer telescopically arranged members;

said outer member having the liner secured thereto;

(1) hanger means supported on the liner for hanging the liner on the well bore casing; and (2) bearing means on said outer member to accommodate rotation of said outer member and the liner relative to the casing and said hanger means;

said inner member having a non-circular mandrel connected with the operating string;

means supporting said outer member and the liner on said inner member, said means including:

(1) thread means on said outer member; and (2) disengaging nut means threadedly secured on said thread means telescopically receiving said mandrel whereby longitudinal movement and then rotation of the operating string disconnects said disengaging nut means from said thread means and releases said outer member from said inner member and the operating string;

means on said inner and outer members to reciprocate and rotate the liner by manipulating the operating string before the liner is supported on the casing;

said means to reciprocate before supporting the liner on the casing including shoulder means on said disengaging nut means and abutting shoulder means on said inner member whereby the liner may be reciprocated in the well bore by raising and lowering the operating string;

said means to rotate before supporting the liner on the casing including first longitudinal slot means in said outer member and spring biased longitudinal key means on said inner member engaged in said slot means whereby the liner may be rotated by rotating the operating string; and additional means on said inner and outer members releasably engageable after said inner and outer members are released from each other to rotate said outer member and liner relative to said hanger means and the casing upon rotating the operating string, said additional means including inter-fitting groove and circumferentially spaced rigid projection means formed adjacent the upper end of said outer member and the lower end of the operating string respectively.

51. The apparatus of claim 46 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

hanger means for hanging the liner on the well bore casing;

means for releasably connecting the operating string with the liner and said liner hanger means;

said hanger means including:

first sleeve means mounted on the liner for rotation of the liner relative thereto;

at least two longitudinally spaced annular rows of conically shaped, circumferentially spaced segments on said first sleeve means with the segments in each row being off-set circumferentially;

second sleeve means slidably mounted on the liner for relative rotation and longitudinal movement between said second sleeve means and the liner, said second sleeve means being spaced from said first sleeve means;

at least two rows of hanger slips supported by said second sleeve means with said hanger slips in each row being off-set circumferentially and with said hanger slips in each row being aligned with the segments in a row of segments;

means secured to said hanger slips adjacent one end and to said second sleeve means at the other end;

release means for releasably securing said second sleeve means to the liner whereby said second sleeve means may be released for relative longitudinal movement between it and said first sleeve means to simultaneously engage all said rows of hanger slips on said respective rows of conical segments to hang the liner in the well bore casing by said hanger means;

said release means including:

a J-shaped slot in said second sleeve means;

lug means on the liner and engaged in said slot;

bow spring means on said second sleeve means engageable with the well bore casing whereby as the liner and said first and second sleeve means move through the well bore casing in one direction said lug means is positioned in said slot to restrain relative longitudinal movement between the liner and said second sleeve means; and said latch means, upon longitudinal movement of the liner in the other direction in the well bore casing and then rotating it while said second sleeve means is restrained by said bow spring means engaging the well bore casing, releasing to accommodate longitudinal movement of said second sleeve means relative to the liner to engage said hanger slips and conical segments for urging said hanger slips radially into gripping engagement with the well bore casing;

bearing means on the liner to accommodate rotation of the liner; and cooperating means on the operating string and liner to rotate and reciprocate the liner before hanging it and for rotating the liner after it is hung on the well bore casing.

52. The apparatus of claim 46 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

hanger means for hanging the liner on the well bore casing;

means for releasably connecting the operating string with the liner and said liner hanger means;

said hanger means including:

first sleeve means mounted on the liner for rotation of the liner relative thereto;

at least two longitudinally spaced annular rows of conically shaped, circumferentially spaced segments on said first sleeve means with the segments in each row being off-set circumferentially;

second sleeve means slidably mounted on the liner for relative rotation and longitudinal movement between said second sleeve means and the liner, said second sleeve means being spaced from said first sleeve means;

at least two rows of hanger slips supported by said second sleeve means with said hanger slips in each row being off-set circumferentially and with said hanger slips in each row being aligned with the segments in a row of segments;

means secured to said hanger slips adjacent one end and to said second sleeve means at the other end;

release means for releasably securing said second sleeve means to the liner whereby said second sleeve means may be released for relative longitudinal movement between it and said first sleeve means to simultaneously engage all said rows of hanger slips on said respective rows of conical segments to hang the liner in the well bore casing by said hanger means;

said release means including:

an annular longitudinally extending chamber in the liner in which one end of said second sleeve means is telescopically received; and seal means sealing between the annular chamber and said second sleeve means responsive to fluid pressure through a port in the liner for moving said second sleeve means longitudinally for engagement of said hanger slips with said conical segments for urging said hanger slips radially into gripping engagement with the well bore casing;

bearing means on the liner to accommodate rotation of the liner; and cooperating means on the operating string and liner to rotate and reciprocate the liner before hanging it and for rotating the liner after it is hung on the well bore casing.

53. Apparatus for cementing a liner in a well bore casing wherein the liner is releasably supported on an operating string having a bore for supplying cement through the liner to the well bore cementing region, comprising:

seal means for sealing between the liner and the operating string;

means for positioning the liner in the well bore;

first and second spaced plug means for wiping the operating string bore ahead of and behind, respectively, the cement;

first and second wiper means, each having a longitudinal bore therein for receiving, respectively, said first and second spaced plug means therein for wiping the liner ahead of and behind, respectively, the cement upon engagement, respectively, with said first and second spaced plug means for movement through the liner;

said second wiper means having circumferentially spaced openings through which the operating string extends longitudinally; and means for releasably securing said first wiper means to the operating string which extends through the circumferentially spaced openings in the operating string adjacent the lower end of said second wiper means so that the longitudinal bore of said first wiper means originates and extends away from adjacent the lower end of the operating string and said lower end of said second wiper means.

54. The apparatus of claim 53 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes hanger means on the liner for securing the liner to the casing in the well bore and means for securing the liner with the hanger means thereon on the operating string whereby the liner and operating string may be disconnected from each other upon relative rotation therebetween, said hanger means including:

at least one cone shaped enlargement on the liner;

at least one sleeve means slidable on the liner;

slip means on said sleeve means;

cooperating latch means on the liner and said sleeve means for releasably securing them together;

said latch means including:

a J-shaped slot in said sleeve means;

lug means on the liner and engaged in said slot; and bow spring means on said sleeve means engageable with the well bore casing whereby as the liner and sleeve means move through the well bore casing in one direction said lug means is positioned in said slot to restrain relative longitudinal and rotational movement between the liner and said sleeve means; and said latch means, upon longitudinal movement of the liner in the other direction in the well bore casing and then rotating it while said sleeve means is restrained by said bow spring means engaging the well bore casing, releasing to accommodate longitudinal movement of said slip means relative to the liner to engage said slip means and cone shaped enlargement for urging said slip means radially into gripping engagement with the well bore casing.

55. The apparatus of claim 53 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes hanger means on the liner for securing the liner to the casing in the well bore and means for securing the liner with the hanger means thereon on the operating string whereby the liner and operating string may be disconnected from each other upon relative rotation therebetween said hanger means including:

at least one cone shaped enlargement on the liner;

at least one sleeve means slidable on the liner;

slip means on said slidable sleeve means;

releasable means for securing one of said sleeve means to the liner;

the liner having at least one annular chamber thereon in which one end of one of said slidable sleeve means is telescopically received;

seal means sealing between the annular chamber and said sleeve means responsive to fluid pressure through port means in the liner for moving said one of said sleeve means longitudinally for engagement of said slip means with said cone shaped enlargement for urging said slip means radially into gripping engagement with the well bore casing; and means for restricting fluid flow through the operating string for supplying fluid pressure from the operating string through the port means therein to the annular chamber.

56. The apparatus of claim 53 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

means to rotate and reciprocate the liner before supporting it on the well bore casing and for rotating the liner after it is supported on the well bore casing comprising:

inner and outer telescopically arranged members;

said outer member having the liner secured thereto;

(1) hanger means supported on the liner for hanging the liner on the well bore casing; and (2) bearing means on said outer member to accommodate rotation of said outer member and the liner relative to the casing and said hanger means;

said inner member having a non-circular mandrel connected with the operating string;

means supporting said outer member and the liner on said inner member, said means including:

(1) thread means on said outer member; and (2) disengaging nut means threadedly secured on said thread means telescopically receiving said mandrel whereby longitudinal movement and then rotation of the operating string disconnects said disengaging nut means from said thread means and releases said outer member from said inner member and the operating string;

means on said inner and outer members to reciprocate and rotate the liner by manipulating the operating string before the liner is supported on the casing;

said means to reciprocate before supporting the liner on the casing including shoulder means on said disengaging nut means and abutting shoulder means on said inner member whereby the liner may be reciprocated in the well bore by raising and lowering the operating string;

said means to rotate before supporting the liner on the casing including first longitudinal slot means in said outer member and spring biased longitudinal key means on said inner member engaged in said slot means whereby the liner may be rotated by rotating the operating string; and additional means on said inner and outer members releasably engageable after said inner and outer members are released from each other to rotate said outer member and liner relative to said hanger means and the casing upon rotating the operating string, said additional means including second longitudinal slot means in the outer member spaced longitudinally from said first slot means and engageable with said spring biased longitudinal key means on said inner member when the operating string is manipulated to align said key means on said inner member with said second slot means.

57. The apparatus of claim 53 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

means to rotate and reciprocate the liner before supporting it on the well bore casing and for rotating the liner after it is supported on the well bore casing comprising:

inner and outer telescopically arranged members;

said outer member having the liner secured thereto;

(1) hanger means supported on the liner for hanging the liner on the well bore casing; and (2) bearing means on said outer member to accommodate rotation of said outer member and the liner relative to the casing and said hanger means;

said inner member having a non-circular mandrel connected with the operating string;

means supporting said outer member and the liner on said inner member, said means including:

(1) thread means on said outer member; and (2) disengaging nut means threadedly secured on said thread means telescopically receiving said mandrel whereby longitudinal movement and then rotation of the operating string disconnects said disengaging nut means from said thread means and releases said outer member from said inner member and the operating string;

means on said inner and outer members to reciprocate and rotate the liner by manipulating the operating string before the liner is supported on the casing;

said means to reciprocate before supporting the liner on the casing including shoulder means on said disengaging nut means and abutting shoulder means on said inner member whereby the liner may be reciprocated in the well bore by raising and lowering the operating string;

said means to rotate before supporting the liner on the casing including first longitudinal slot means in said outer member and spring biased longitudinal key means on said inner member engaged in said slot means whereby the liner may be rotated by rotating the operating string; and additional means on said inner and outer members releasably engageable after said inner and outer members are released from each other to rotate said outer member and liner relative to said hanger means and the casing upon rotating the operating string, said additional means including inter-fitting groove and circumferentially spaced rigid projection means formed adjacent the upper end of said outer member and the lower end of the operating string, respectively.

58. The apparatus of claim 53 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

hanger means for hanging the liner on the well bore casing;

means for releasably connecting the operating string with the liner and said liner hanger means;

said hanger means including:

first sleeve means mounted on the liner for rotation of the liner relative thereto;

at least two longitudinally spaced annular rows of conically shaped, circumferentially spaced segments on said first sleeve means with the segments in each row being off-set circumferentially;

second sleeve means slidably mounted on the liner for relative rotation and longitudinal movement between said second sleeve means and the liner, said second sleeve means being spaced from said first sleeve means;

at least two rows of hanger slips supported by said second sleeve means with said hanger slips in each row being off-set circumferentially and with said hanger slips in each row being aligned with the segments in a row of segments;

means secured to said hanger slips adjacent one end and to said second sleeve means at the other end;

release means for releasably securing said second sleeve means to the liner whereby said second sleeve means may be released for relative longitudinal movement between it and said first sleeve means to simultaneously engage all said rows of hanger slips on said respective rows of conical segments to hang the liner in the well bore casing by said hanger means;

said release means including:

a J-shaped slot in said second sleeve means;

lug means on the liner and engaged in said slot;

bow spring means on said second sleeve means engageable with the well bore casing whereby as the liner and said first and second sleeve means move through the well bore casing in one direction said lug means is positioned in said slot to restrain relative longitudinal movement between the liner and said second sleeve means; and said latch means, upon longitudinal movement of the liner in the other direction in the well bore casing and then rotating it while said second sleeve means is restrained by said bow spring means engaging the well bore casing, releasing to accommodate longitudinal movement of said second sleeve means relative to the liner to engage said hanger slips and concial segments for urging said hanger slips radially into gripping engagement with the well bore casing;

bearing means on the liner to accommodate rotation of the liner; and cooperating means on the operating string and liner to rotate and reciprocate the liner before hanging it and for rotating the liner after it is hung on the well bore casing.

59. The apparatus of claim 53 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

hanger means for hanging the liner on the well bore casing;

means for releasably connecting the operating string with the liner and said liner hanger means;

said hanger means including:

first sleeve means mounted on the liner for rotation of the liner relative thereto;

at least two longitudinally spaced annular rows of conically shaped, circumferentially spaced segments on said first sleeve means with the segments in each row being off-set circumferentially;

second sleeve means slidably mounted on the liner for relative rotation and longitudinal movement between said second sleeve means and the liner, said second sleeve means being spaced from said first sleeve means;

at least two rows of hanger slips supported by said second sleeve means with said hanger slips in each row being off-set circumferentially and with said hanger slips in each row being aligned with the segments in a row of segments;

means secured to said hanger slips adjacent one end and to said second sleeve means at the other end;

release means for releasably securing said second sleeve means to the liner whereby said second sleeve means may be released for relative longitudinal movement between it and said first sleeve means to simultaneously engage all said rows of hanger slips on said respective rows of conical segments to hang the liner in the well bore casing by said hanger means;

said release means including:

an annular longitudinally extending chamber in the liner in which one end of said second sleeve means is telescopically received; and seal means sealing between the annular chamber and said second sleeve means responsive to fluid pressure through a port in the liner for moving said second sleeve means longitudinally for engagement of said hanger slips with said conical segments for urging said hanger slips radially into gripping engagement with the well bore casing;

bearing means on the liner to accommodate rotation of the liner; and cooperating means on the operating string and liner to rotate and reciprocate the liner before hanging it and for rotating the liner after it is hung on the well bore casing.

60. Apparatus for cementing a liner in a well bore casing wherein the liner is releasably supported on an operating string having a bore for supplying cement through the liner to the well bore cementing region, comprising:

seal means for sealing between the liner and the operating string;

means for positioning the liner in the well bore;

first and second spaced plug means for wiping the operating string bore ahead of and behind, respectively, the cement;

first and second wiper means for wiping the liner ahead and behind, respectively, the cement upon engagement, respectively, with said first and second spaced plug means for movement through the liner;

said second wiper means having the operating string extending therein and terminating in overlapping relation to said first wiper means;

said second wiper means having circumferentially spaced openings through which the operating string extends longitudinally; and means for releasably securing said first wiper means to the operating string at the overlapped relationship.

61. The apparatus of claims 31, or 38, or 46, or 53, or 60 wherein said releasable means secures said second wiper means to the operating string at substantially the same transverse position on the operating string at which said first wiper means is secured.

62. The apparatus of claims 31, or 38, or 46, or 53, or 60 wherein said releasable means secures said second wiper means to the operating string in longitudinal spaced relation to the position at which said releasable means secures said first wiper means to the operating string.

63. The apparatus of claims 31, or 38, or 46, or 53, or 60 wherein releasable means secures said second wiper means to the operating string above said second wiper means.

64. The apparatus of claim 60 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes hanger means on the liner for securing the liner to the casing in the well bore and means for securing the liner with the hanger means thereon on the operating string whereby the liner and operating string may be disconnected from each other upon relative rotation therebetween, said hanger means including:

at least one cone shaped enlargement on the liner;

at least one sleeve means slidable on the liner;

slip means on said sleeve means;

cooperating latch means on the liner and said sleeve means for releasably securing them together;

said latch means including:

a J-shaped slot in said sleeve means;

lug means on the liner and engaged in said slot; and bow spring means on said sleeve means engageable with the well bore casing whereby as the liner and sleeve means move through the well bore casing in one direction said lug means is positioned in said slot to restrain relative longitudinal and rotational movement between the liner and said sleeve means; and said latch means, upon longitudinal movement of the liner in the other direction in the well bore casing and then rotating it while said sleeve means is restrained by said bow spring means engaging the well bore casing, releasing to accommodate longitudinal movement of said slip means relative to the liner to engage said slip means and cone shaped enlargement for urging said slip means radially into gripping engagement with the well bore casing.

65. The apparatus of claim 60 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes hanger means on the liner for securing the liner to the casing in the well bore and means for securing the liner with the hanger means thereon on the operating string whereby the liner and operating string may be disconnected from each other upon relative rotation therebetween, said hanger means including:

at least one cone shaped enlargement on the liner;

at least one sleeve means slidable on the liner;

slip means on said slidable sleeve means;

releasable means for securing one of said sleeve means to the liner;

the liner having an annular chamber thereon in which one end of one of said slidable sleeve means is telescopically received;

seal means sealing between the annular chamber and said sleeve means responsive to fluid pressure through port means in the liner for moving said one of said sleeve means longitudinally for engagement of said slip means said cone shaped enlargement for urging said slip means radially into gripping engagement with the well bore casing; and means for restricting fluid flow through the operating string for supplying fluid pressure from the operating string through the port means therein to the annular chamber.

66. The apparatus of claim 60 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

means to rotate and reciprocate the liner before supporting it on the well bore casing and for rotating the liner after it is supported on the well bore casing comprising:

inner and outer telescopically arranged members;

said outer member having the liner secured thereto;

(1) hanger means supported on the liner for hanging the liner on the well bore casing; and (2) bearing means on said outer member to accommodate rotation of said outer member and the liner relative to the casing and said hanger means;

said inner member having a non-circular mandrel connected with the operating string;

means supporting said outer member and the liner on said inner member, said means including:

(1) thread means on said outer member; and (2) disengaging nut means threadedly secured on said thread means telescopically receiving said mandrel whereby longitudinal movement and then rotation of the operating string disconnects said disengaging nut means from said thread means and releases said outer member from said inner member and the operating string;

means on said inner and outer members to reciprocate and rotate the liner by manipulating the operating string before the liner is supported on the casing;

said means to reciprocate before supporting the liner on the casing including shoulder means on said disengaging nut means and abutting shoulder means on said inner member whereby the liner may be reciprocated in the well bore by raising and lowering the operating string;

said means to rotate before supporting the liner on the casing including first longitudinal slot means in said outer member and spring biased longitudinal key means on said inner member engaged in said slot means whereby the liner may be rotated by rotating the operating string; and additional means on said inner and outer members releasably engageable after said inner and outer members are released from each other to rotate said outer member and liner relative to said hanger means and the casing upon rotating the operating string, said additional means including second longitudinal slot means in the outer member spaced longitudinally from said first slot means and engageable with said spring biased longitudinal key means on said inner member when the operating string is manipulated to align said key means on said inner member with said second slot means.

67. The apparatus of claim 60 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

means to rotate and reciprocate the liner before supporting it on the well bore casing and for rotating the liner after it is supported on the well bore casing comprising:

inner and outer telescopically arranged members;

said outer member having the liner secured thereto;

(1) hanger means supported on the liner for hanging the liner on the well bore casing; and (2) bearing means on said outer member to accommodate rotation of said outer member and the liner relative to the casing and said hanger means;

said inner member having a non-circular mandrel connected with the operating string;

means supporting said outer member and the liner on said inner member, said means including:

(1) thread means on said outer member; and (2) disengaging nut means threadedly secured on said thread means telescopically receiving said mandrel whereby longitudinal movement and then rotation of the operating string disconnects said disengaging nut means from said thread means and releases said outer member from said inner member and the operating string;

means on said inner and outer members to reciprocate and rotate the liner by manipulating the operating string before the liner is supported on the casing;

said means to reciprocate before supporting the liner on the casing including shoulder means on said disengaging nut means and abutting shoulder means on said inner member whereby the liner may be reciprocated in the well bore by raising and lowering the operating string;

said means to rotate before supporting the liner on the casing including first longitudinal slot means in said outer member and spring biased longitudinal key means on said inner member engaged in said slot means whereby the liner may be rotated by rotating the operating string; and additional means on said inner and outer members releasably engageable after said inner and outer members are released from each other to rotate said outer member and liner relative to said hanger means and the casing upon rotating the operating string, said additional means including inter-fitting groove and circumferentially spaced rigid projection means formed adjacent the upper end of said outer member and the lower end of the operating string, respectively.

68. The apparatus of claim 60 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

hanger means for hanging the liner on the well bore casing;

means for releasably connecting the operating string with the liner and said liner hanger means;

said hanger means including:

first sleeve means mounted on the liner for rotation of the liner relative thereto;

at least two longitudinally spaced annular rows of conically shaped, circumferentially spaced segments on said first sleeve means with the segments in each row being off-set circumferentially;

second sleeve means slidably mounted on the liner for relative rotation and longitudinal movement between said second sleeve means and the liner, said second sleeve means being spaced from said first sleeve means;

at least two rows of hanger slips supported by said second sleeve means with said hanger slips in each row being off-set circumferentially and with said hanger slips in each row being aligned with the segments in a row of segments;

means secured to said hanger slips adjacent one end and to said second sleeve means at the other end;

release means for releasably securing said second sleeve means to the liner whereby said second sleeve means may be released for relative longitudinal movement between it and said first sleeve means to simultaneously engage all said rows of hanger slips on said respective rows of conical segments to hang the liner in the well bore casing by said hanger means;

said release means including:

a J-shaped slot in said second sleeve means;

lug means on the liner and engaged in said slot;

bow spring means on said second sleeve means engageable with the well bore casing whereby as the liner and said first and second sleeve means move through the well bore casing in one direction said lug means is positioned in said slot to restrain relative longitudinal movement between the liner and said second sleeve means; and said latch means, upon longitudinal movement of the liner in the other direction in the well bore casing and then rotating it while said second sleeve means is restrained by said bow spring means engaging the well bore casing, releasing to accommodate longitudinal movement of said second sleeve means relative to the liner to engage said hanger slips and conical segments for urging said hanger slips radially into gripping engagement with the well bore casing;

bearing means on the liner to accommodate rotation of the liner; and cooperating means on the operating string and liner to rotate and reciprocate the liner before hanging it and for rotating the liner after it is hung on the well bore casing.

69. The apparatus of claim 60 wherein said seal means includes:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

and wherein said means for positioning the liner in the well bore includes:

hanger means for hanging the liner on the well bore casing;

means for releasably connecting the operating string with the liner and said liner hanger means;

said hanger means including:

first sleeve means mounted on the liner for rotation of the liner relative thereto;

at least two longitudinally spaced annular rows of conically shaped, circumferentially spaced segments on said first sleeve means with the segments in each row being off-set circumferentially;

second sleeve means slidably mounted on the liner for relative rotation and longitudinal movement between said second sleeve means and the liner, said second sleeve means being spaced from said first sleeve means;

at least two rows of hanger slips supported by said second sleeve means with said hanger slips in each row being off-set circumferentially and with said hanger slips in each row being aligned with the segments in a row of segments;

means secured to said hanger slips adjacent one end and to said second sleeve means at the other end;

release means for releasably securing said second sleeve means to the liner whereby said second sleeve means may be released for relative longitudinal movement between it and said first sleeve means to simultaneously engage all said rows of hanger slips on said respective rows of conical segments to hang the liner in the well bore casing by said hanger means;

said release means including:

an annular longitudinally extending chamber in the liner in which one end of said second sleeve means is telescopically received; and seal means sealing between the annular chamber and said second sleeve means responsive to fluid pressure through a port in the liner for moving said second sleeve means longitudinally for engagement of said hanger slips with said conical segments for urging said hanger slips radially into gripping engagement with the well bore casing;

bearing means on the liner to accommmodate rotation of the liner; and cooperating means on the operating string and liner to rotate and reciprocate the liner before hanging it and for rotating the liner after it is hung on the well bore casing.

70. Apparatus for cementing operations in a well bore wherein cement is conducted to the well bore through an operating string member comprising:

lower and upper seal means for wiping ahead of and behind, respectively, the cement;

at least one of said seal means having circumferentially spaced openings through which the operating string extends longitudinally; and means for releasably securing said upper and lower seal means to the operating string.

71. Apparatus for cementing operations in a well bore wherein cement is conducted to the well bore through an operating string comprising:

lower and upper wiper means including lower and upper plug means for wiping ahead of and behind, respectively, the cement;

said upper wiper means having a portion extending through the operating string to receive said upper plug means thereon; and means for releasably securing said upper and lower wiper means to the operating string.

72. Apparatus for cementing a liner in a well bore wherein cement enters the liner from an operating string and flows to the cementing region, comprising:

lower and upper spaced plug means for wiping the operating string ahead of and behind, respectively, the cement;

lower and upper wiper means for wiping the liner ahead of and behind, respectively, the cement upon engagement, respectively, with the lower and upper plug means for movement through the liner;

said upper wiper means having a portion extending through the operating string to receive said upper plug means thereon;

said upper wiper means having circumferentially spaced openings to receive the operating string longitudinally therethrough; and means for releasably securing said upper and lower wiper means to the operating string.

73. Apparatus for cementing a liner in a well bore casing wherein the cement enters the liner through an operating string and flows through the liner to the cementing region, comprising:

first and second spaced plug means for wiping the operating string ahead of and behind, respectively, the cement;

first and second spaced wiper means for wiping the liner ahead of and behind, respectively, the cement upon engagement, respectively, with said first and second plug means for movement through the liner;

said second wiper means having circumferentially spaced openings through which the operating string extends longitudinally;

means for releasably securing said first and second wiper means to the operating string;

means for catching said first wiper and plug means in the liner;

means for releasing said first plug means for movement longitudinally relative to said first wiper means when said catching means catches said first wiper means; and means for securing said first and second wiper and plug means together as a unit in said catcher means after displacement of cement to the cementing region.

74. A method of cementing a liner that is sealably and releasably supported on an operating string in a well bore having casing comprising the steps of:

releasably securing upper and lower wiper means to the operating string which extends through circumferential openings in the upper wiper means and terminates in overlapping relation with the lower wiper means;

lowering the operating string with the wiper means thereon in the well bore;

selectively rotating and/or reciprocating the liner in the well bore;

releasing the liner from the operating string and suspending the liner on the casing in the well bore;

discharging lower plug means into the operating string to wipe the operating string with cement therebehind;

seating and locking the lower plug means in the lower wiper means and releasing the lower wiper means with the lower plug means therein from the overlapped operating string for wiping ahead of the cement;

discharging upper plug means into the operating string to wipe the operating string behind the cement;

seating the upper plug means on the upper wiper means and releasing the upper wiper means with the plug means thereon from the operating string extending through the upper wiper means for wiping behind the cement;

moving the lower wiper and plug means through the liner to wipe ahead of the cement;

moving the upper wiper and plug means through the liner to wipe behind the cement;

discharging the cement from the liner into the well bore; and selectively rotating the liner during and/or after the cementing.

75. A method of cementing a liner that is sealably and releasably supported on an operating string in a well bore having casing comprising the steps of:

releasably securing upper and lower wiper means to the operating string with the lower wiper means secured below the smallest internal diameter of the upper wiper means;

lowering the operating string with the wiper means thereon in the well bore;

selectively rotating and/or reciprocating the liner in the well bore;

releasing the liner from the operating string and suspending the liner on the casing in the well bore;

discharging lower plug means into the operating string to wipe the operating string with cement therebehind;

seating and locking the lower plug means in the lower wiper means and releasing the lower wiper means with the lower plug means therein from the operating string for wiping ahead of the cement;

discharging upper plug means into the operating string to wipe the operating string behind the cement;

seating the upper plug means within the upper wiper means and releasing the upper wiper means with the plug means thereon from the operating string for wiping behind the cement;

moving the lower wiper and plug means through the liner to wipe ahead of the cement;

moving the upper wiper and plug means through the liner to wipe behind the cement;

discharging the cement from the liner into the well bore; and selectively rotating the liner during and/or after the cementing.

76. A method of cementing a liner that is sealably and releasably supported on an operating string in a well bore having casing comprising the steps of:

releasably securing upper and lower wiper means to the operating string so that the upper wiper means has a portion extending through and into the bore of the operating string;

lowering the operating string with the wiper means thereon in the well bore;

selectively rotating and/or reciprocating the liner in the well bore;

releasing the liner from the operating string and suspending the liner on the casing in the well bore;

discharging lower plug means into the operating string to wipe the operating string with cement therebehind;

seating and locking the lower plug means in the lower wiper means and releasing the lower wiper means with the lower plug means therein from the operating string for wiping ahead of the cement;

discharging upper plug means into the operating string to wipe the operating string behind the cement;

seating the upper plug means on the upper wiper means portion that extends through and into the bore of the operating string;

moving the lower wiper and plug means through the liner to wipe ahead of the cement;

moving the upper wiper and plug means through the liner to wipe behind the cement;

discharging the cement from the liner into the well bore; and selectively rotating the liner during and/or after the cementing.

77. A method of cementing a liner that is sealably and releasably supported on an operating string in a well bore having casing comprising the steps of:

releasably securing upper and lower wiper means to the operating string wherein the operating string extends through circumferential openings in the upper wiper means and terminates adjacent the lower end of the upper wiper means whereby the lower wiper means is releasably secured to the operating string so that the longitudinal bore of the lower wiper means originates adjacent and extends away from adjacent the lower portion of the upper wiper means and the operating string;

lowering the operating string with the wiper means thereon in the well bore;

selectively rotating and/or reciprocating the liner in the well bore;

releasing the liner from the operating string and suspending the liner on the casing in the well bore;

discharging lower plug means and cement therebehind into the operating string to wipe the operating string ahead of the cement;

seating and locking the lower plug means in the lower wiper means and releasing the lower wiper means with the lower plug means therein from the operating string for wiping ahead of the cement;

discharging upper plug means into the operating string to wipe the operating string behind the cement;

seating the upper plug means within the upper wiper means and releasing the upper wiper means with the plug means therein from the operating string for wiping behind the cement;

moving the lower wiper and plug means through the liner to wipe ahead of the cement;

moving the upper wiper and plug means through the liner to wipe behind the cement;

discharging the cement from the liner into the well bore; and selectively rotating the liner during and/or after the cementing.

78. A method of cementing a liner that is sealably and releasably supported on an operating string in a well bore having casing comprising the steps of:

releasably securing upper and lower wiper means to the operating string which extends through circumferential openings in the upper wiper means and so that the upper wiper means extends through openings in the operating string;

lowering the operating string with the wiper means thereon in the well bore;

selectively rotating and/or reciprocating the liner in the well bore;

releasing the liner from the operating string and suspending the liner on the casing in the well bore;

discharging lower plug means and cement therebehind into the operating string to wipe the operating string with the cement therebehind;

seating and locking the lower plug means in the lower wiper means and releasing the lower wiper means with the lower plug means therein from the operating string for wiping ahead of the cement;

discharging upper plug means into the operating string to wipe the operating string behind the cement;

seating the upper plug means within the upper wiper means and releasing the upper wiper means with the plug means therein from the operating string for wiping behind the cement;

moving the lower wiper and plug means through the liner to wipe ahead of the cement;

moving the upper wiper and plug means through the liner to wipe behind the cement;

discharging the cement from the liner into the well bore; and selectively rotating the liner during and/or after the cementing.

79. A method of cementing a liner that is sealably and releasably supported on an operating string in a well bore having casing comprising the steps of:

releasably securing upper and lower wiper means to the operating string so that the upper wiper means has a portion extending through and into the bore of the operating string with the lower wiper means releasably secured below the upper wiper means portion extending through the operating string bore;

lowering the operating string with the wiper means thereon in the well bore;

selectively rotating and/or reciprocating the liner in the well bore;

releasing the liner from the operating string and suspending the liner on the casing in the well bore;

discharging lower plug means into the operating string to wipe the operating string with cement therebehind;

seating and locking the lower plug means in the lower wiper means and releasing the lower wiper means with the lower plug means therein from the operating string for wiping ahead of the cement;

discharging upper plug means into the operating string to wipe the operating string behind the cement;

seating the upper plug means on the upper wiper means portion that extends through and into the bore of the operating string so that the upper plug means wipes the operating string;

moving the lower wiper and plug means and upper wiper and plug means, respectively, through the liner at spaced intervals to wipe ahead of and behind the cement;

moving the upper wiper and plug means through the liner to wipe behind the cement;

discharging the cement from the liner into the well bore; and selectively rotating the liner during and/or after the cementing.

80. The method of claims 74, or 75, or 76, or 77, or 78, or 79, including the step of moving the lower wiper and plug means to a predetermined location in the liner and then releasing the lower plug means from the lower wiper means to communicate the liner with the well bore for discharge of the cement therefrom.

81. The method of claims 74, or 75, or 76, or 77, or 78, or 79, including the step of simultaneously suspending the liner on the casing at two or more longitudinally spaced positions to distribute the liner load on the casing among the longitudinally spaced positions.

82. Apparatus for cementing a liner in a well bore wherein the cement enters the liner through the bore of an operating string and flows through the liner to the cementing region, comprising:

seal means for sealing between the liner and the operating string;

first and second spaced plug means for wiping the operating string bore ahead of and behind, respectively, the cement;

first and second wiper means for wiping the liner ahead of and behind, respectively, the cement upon engagement, respectively, with said upper and lower spaced plug means for movement through the liner;

said second wiper means having circumferentially spaced openings through which the operating string extends longitudinally; and means for releasably securing said lower wiper means to the operating string.

83. Apparatus for cementing a liner in a well bore wherein the liner is releasably supported on an operating string having a bore for supplying cement through the liner to the well bore cementing region, comprising:

seal means for sealing between the liner and the operating string;

first and second spaced plug means for wiping the operating string bore ahead of and behind, respectively, the cement;

first and second wiper means for wiping ahead of and behind, respectively, the cement upon engagement, respectively, with said upper and lower spaced plug means for movement through the liner;

said second wiper means having a portion extending through the operating string and into the bore thereof to receive said second plug means for movement of said second wiper and plug means together through the liner; and means for releasably securing said first wiper means to the operating string adjacent said second wiper means portion.

84. Apparatus for cementing a liner in a well bore wherein the liner is releasably supported on an operating string having a well bore for supplying cement through the liner to the well bore cementing region, comprising:

seal means for sealing between the liner and the operating string;

first and second spaced plug means for wiping the operating string bore ahead of and behind, respectively, the cement;

first and second wiper means for wiping the liner ahead of and behind, respectively, the cement upon engagement, respectively, with said upper and lower spaced plug means for movement through the liner;

said second wiper means having means thereon which extend through circumferentially spaced openings in the operating string to form a smaller internal diameter then the remainder of the bore of said second wiper means whereby said second plug means seats on said smaller diameter so that said second wiper and plug means wipes behind the cement in the liner; and means for releasably securing said first wiper means to the operating string below the smallest internal diameter in said second wiper means.

85. Apparatus for cementing a liner in a well bore wherein the liner is releasably supported on an operating string having a bore for supplying cement through the liner to the well bore cementing region, comprising:

seal means for sealing between the liner and the operating string;

first and second spaced plug means for wiping the operating string bore ahead of and behind, respectively, the cement;

first and second wiper means, each having a longitudinal bore therein for receiving, respectively, said first and second spaced plug means therein for wiping the liner ahead of and behind, respectively, the cement upon engagement, respectively, with said upper and lower spaced plug means for movement through the liner; and means for releasably securing said first wiper means to the operating string which extends through the longitudinal bore of said second wiper means to terminate, respectively, adjacent the lower and upper ends of said second and first wiper means so that the longitudinal bore of said first wiper means originates and extends away from adjacent said lower end of said second wiper means and the operating string.

86. Apparatus for cementing a liner in a well bore wherein the liner is releasably supported on an operating string having a bore for supplying cement through the liner to the well bore cementing region, comprising:

seal means for sealing between the liner and the operating string;

first and second spaced plug means for wiping the operating string bore ahead of and behind, respectively, the cement;

first and second wiper means for wiping the liner ahead and behind, respectively, the cement upon engagement, respectively, with said first and second spaced plug means for movement through the liner;

said second wiper means having the operating string extending through circumferential openings therein and terminating in overlapping relation to said first wiper means below the smallest internal diameter of said second wiper means; and means for releasably securing said first and second wiper means to the operating string at the overlapped relationship.

87. In apparatus for cementing operations in a well bore wherein cement is conducted to the well bore through a tubular member, the improvement comprising:

wiper means for effecting a movable wiper within the tubular member said wiper means including:

a body;

said body having a longitudinal bore therethrough;

a plug for sealably seating within the bore of said body; and said body having circumferentially spaced openings through which the tubular member extends longitudinally for releasably supporting said body on the tubular member.

88. The apparatus of claim 87 including means for releasably securing said body to the tubular member.

89. A method of cementing a liner that is sealably and releasably supported on an operating string in a well bore comprising the steps of:

releasably securing upper and lower wiper means to the operating string so that the upper wiper means has a portion extending through and into the bore of the operating string;

lowering the operating string with the wiper means thereon in the well bore;

releasing the liner from the operating string in the well bore;

discharging lower plug means and cement into the operating string to wipe the operating string with the cement therebehind;

seating and locking the lower plug means in the lower wiper means and releasing the lower wiper means with the lower plug means therein from the upper wiper means portion extending through and into the bore of the operating string for wiping ahead of the cement;

discharging upper plug means into the operating string to wipe the operating string behind the cement;

seating the upper plug means within the upper wiper means portion that extends through and into the bore of the operating string;

moving the lower wiper and plug means through the liner to wipe ahead of the cement;

moving the upper wiper and plug means through the liner to wipe behind the cement; and discharging the cement from the liner into the well bore.

90. A method of cementing a liner that is sealably and releasably supported on an operating string in a well bore comprising the steps of:

releasably securing an upper and lower wiper means to the operating string wherein the operating string extends through circumferential openings in the upper wiper means and terminates in overlapping relation with the lower wiper means below the smallest internal diameter of the upper wiper means, and the lower wiper means being releasably secured to the operating string so that the longitudinal bore of the lower wiper means originates adjacent and extends away from the lower end portion of the operating string and the upper wiper means;

lowering the operating string with the wiper means thereon in the well bore;

releasing the liner from the operating string in the well bore;

discharging lower plug means and cement into the operating string to wipe the operating string with the cement therebehind;

seating and locking the lower plug means in the lower wiper means and releasing the lower wiper means with the lower plug means therein from the operating string for wiping ahead of the cement;

discharging upper plug means into the operating string to wipe behind the cement;

seating the upper plug means within the upper wiper means and releasing the upper wiper means with the plug means through the liner to wipe behind the cement;

moving the lower wiper and plug means through the liner to wipe therewith ahead of the cement;

moving the upper wiper and plug means through the liner to wipe behind the cement; and discharging the cement from the liner into the well bore.

91. A method of cementing in a well bore with an operating string comprising the steps of:

releasably securing wiper means to the operating string wherein the operating string extends through circumferential openings in the wiper means;

lowering the operating string with the wiper means thereon in the well bore;

discharging plug means into the operating string with cement therebehind; and releasing the wiper means from the operating string for discharge of the cement into the well bore.

* * * * *

UNITED STATES PATENT AND TRADEMARK OFFICE

CERTIFICATE OF CORRECTION

PATENT NO. : 4,966,236

DATED : October 30, 1990

INVENTOR(S) : Britt O. Braddick

It is certified that error appears in the above-identified patent and that said Letters Patent is hereby corrected as shown below:

Column 3, line 55, "is" should read --in--.

Column 4, line 11, "the setting", should read --setting--.

Column 6, line 24, "46*b*spaced" should read --46*b*' spaced--.

Column 6, line 25, "46" should read --46'--.

Column 9, line 20, "461" should read --46*l*--.

Column 15, line 66, "91*a*" should read --91*a*'--.

Column 32, line 18, "inner" should read --liner--.

Column 40, line 26, after "liner" insert --in--.

Column 57, line 25, after "means" insert --with--.

Signed and Sealed this

Seventh Day of April, 1992

*Attest:*

HARRY F. MANBECK, JR.

*Attesting Officer*

*Commissioner of Patents and Trademarks*